US007962071B2

(12) United States Patent
Tsuda et al.

(10) Patent No.: US 7,962,071 B2
(45) Date of Patent: Jun. 14, 2011

(54) DEVELOPING DEVICE AND IMAGE FORMING APPARATUS USING SAME

(75) Inventors: Kiyonori Tsuda, Kanagawa (JP); Koichi Kato, Kanagawa (JP); Yuki Oshikawa, Kanagawa (JP); Yasufumi Takahashi, Tokyo (JP); Eriko Maruyama, Kanagawa (JP); Koichi Sakata, Shizuoka (JP); Hitoshi Ishibashi, Kanagawa (JP); Kentaroh Tomita, Kanagawa (JP); Mugijirou Uno, Kanagawa (JP); Keiko Matsumoto, Kanagawa (JP); Kohichi Utsunomiya, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 557 days.

(21) Appl. No.: 12/020,172

(22) Filed: Jan. 25, 2008

(65) Prior Publication Data

US 2008/0181670 A1 Jul. 31, 2008

(30) Foreign Application Priority Data

Jan. 26, 2007 (JP) ..... 2007-016210
Aug. 28, 2007 (JP) ..... 2007-221358

(51) Int. Cl.
*G03G 15/08* (2006.01)

(52) U.S. Cl. ..... 399/260; 399/254; 399/120; 399/107

(58) Field of Classification Search ..... 399/107, 399/119, 120, 252, 254–256, 258, 260, 262, 399/263

See application file for complete search history.

(56) References Cited

U.S. PATENT DOCUMENTS

| | | | | |
|---|---|---|---|---|
| 6,826,378 | B2 * | 11/2004 | Ochiai | 399/103 |
| 7,062,207 | B2 | 6/2006 | Tsuda et al. | |
| 7,072,602 | B2 | 7/2006 | Hatori et al. | |
| 7,076,192 | B2 | 7/2006 | Tsuda et al. | |
| 7,136,610 | B2 | 11/2006 | Arai et al. | |
| 7,146,122 | B2 | 12/2006 | Hatori et al. | |
| 7,184,691 | B2 | 2/2007 | Kita et al. | |
| 7,315,715 | B2 | 1/2008 | Tsuda et al. | |
| 7,321,744 | B2 | 1/2008 | Hosokawa et al. | |
| 2002/0064401 | A1 * | 5/2002 | Ashikari | 399/258 |
| 2004/0114966 | A1 * | 6/2004 | Masuda | 399/260 |
| 2005/0281590 | A1 * | 12/2005 | Tsuda et al. | 399/258 |
| 2006/0083555 | A1 | 4/2006 | Uchiyama et al. | |

(Continued)

FOREIGN PATENT DOCUMENTS

JP 5-127537 5/1993

(Continued)

OTHER PUBLICATIONS

U.S. Appl. No. 12/187,015, filed Aug. 6, 2008, Oshikawa, et al.

(Continued)

*Primary Examiner* — David P Porta
*Assistant Examiner* — Jessica L Eley
(74) *Attorney, Agent, or Firm* — Oblon, Spivak, McClelland, Maier & Neustadt, L.L.P.

(57) ABSTRACT

A developing device which can stably supply a developer to a latent image carrier by preventing the scattered developer from being discharged and thereby preventing the developer from being discharged despite that the amount of developer within the developing device does not increase, and an image forming apparatus using the developing device. A block member serving as a scattered developer discharge prevention member is provided so as to block a path through which the developer scattered as a result of a conveyance operation of a supply screw serving as a developer conveying member moves toward a developer discharge port. Accordingly, the scattered developer is prevented from reaching the developer discharge port and being discharged therefrom.

19 Claims, 21 Drawing Sheets

U.S. PATENT DOCUMENTS

| | | | | |
|---|---|---|---|---|
| 2007/0059025 | A1* | 3/2007 | Lee | 399/98 |
| 2007/0081835 | A1 | 4/2007 | Tsuda et al. | |
| 2007/0116494 | A1 | 5/2007 | Uno et al. | |
| 2007/0140747 | A1 | 6/2007 | Kita et al. | |
| 2007/0160392 | A1 | 7/2007 | Tsuda et al. | |
| 2007/0166074 | A1 | 7/2007 | Hosokawa et al. | |
| 2007/0177905 | A1 | 8/2007 | Hosokawa et al. | |
| 2007/0212119 | A1 | 9/2007 | Kurenuma et al. | |
| 2007/0264052 | A1 | 11/2007 | Yoshida et al. | |
| 2007/0264054 | A1 | 11/2007 | Tsuda et al. | |

FOREIGN PATENT DOCUMENTS

| | | |
|---|---|---|
| JP | 10-293450 | 11/1998 |
| JP | 11-7195 | 1/1999 |
| JP | 11-24382 | 1/1999 |
| JP | 2891845 | 2/1999 |
| JP | 2000-47474 | 2/2000 |
| JP | 2005-292511 | 10/2005 |
| JP | 2006-323238 | 11/2006 |

OTHER PUBLICATIONS

U.S. Appl. No. 12/194,649, filed Aug. 20, 2008, Kita, et al.
U.S. Appl. No. 12/246,027, filed Oct. 6, 2008, Uno et al.
U.S. Appl. No. 12/238,815, filed Sep. 26, 2008, Utsunomiya, et al.
U.S. Appl. No. 12/235,135, filed Sep. 22, 2008, Kato, et al.
U.S. Appl. No. 12/253,538, filed Oct. 17, 2008, Uno, et al.
U.S. Appl. No. 12/250,046, filed Oct. 13, 2008, Tsuda.
U.S. Appl. No. 12/252,693, filed Oct. 16, 2008, Sakata.
Office Action mailed Sep. 1, 2010, in co-pending U.S. Appl. No. 12/204,337.

* cited by examiner

DEVELOPING DEVICE AND IMAGE FORMING APPARATUS USING SAME

BACKGROUND OF THE INVENTION

1. Field of the Invention

The present invention relates to a developing device used in a copying machine, a facsimile device, a printer and the like, and to an image forming apparatus using the developing device.

2. Description of the Related Art

There has conventionally been widely used an image forming apparatus with a developing device using a two-component developer consisting of toner and magnetic carrier. As this type of image forming apparatus, there is an image forming apparatus in which toner is replenished, according to need, from a toner container to a developer contained in a developing device that consumes toner as it conducts development, and thereby the toner density of the developer is maintained within a predetermined range. In such a configuration, because the carrier within the developer is repeatedly used without being consumed significantly, the coated layer on the surface layer of the carrier is worn when an image is output, or a toner resin or an additive is adhered to the coat layer. Consequently, the ability of the carrier to charge the toner decreases gradually, deteriorating the carrier. Toner charge amount decreases as the deterioration of the carrier progresses, causing scumming or toner scattering. Therefore, a serviceman is sent to the user of this type of image forming apparatus to replace the carrier regularly. For this reason, the maintenance cost and the cost per image formation increase.

Japanese Unexamined Patent Application No. 2005-292511 describes a developing device in which pre-mixed developer with a mixture of carrier and toner is replenished into developer contained in the developing device to recover the toner density, and at the same time the increment of the developer is discharged from the developing device. In such a configuration, old carrier is discharged little by little from the developing device by discharging the developer, and at the same time new carrier within the pre-mixed developer is replenished to the developer contained in the developing device. Then, the carrier is replaced with new carrier little by little by performing the discharge and replenishment, whereby the carrier replacement work can be omitted.

Moreover, in this developing device, a developer discharge port for discharging the developer to the outside of the device is provided at a predetermined height level of the position where the developer bulk increases or decreases as the amount of developer in the entire developer conveyance path increases or decreases. In this developing device, when the pre-mixed toner is replenished and the amount of developer within the developing device increases, the developer bulk increases in a supply conveyance path. At this moment, the developer that has reached the level of the developer discharge port in the position provided with the developer discharge port is discharged from the developer discharge port to the outside of the developing device.

However, the developer conveyed within the developer conveyance path is scattered by its moving force or by the rotating force of a conveying member providing the developer with a conveying force when the conveying member is a developer conveying screw, and the scattered developer is sometimes discharged from the developer discharge port. The scattered developer is discharged, even if the developer is conveyed within the developer conveyance path in appropriate amount or less. In this situation, the developer is discharged even if the amount of developer within the developing device is not increased. If the developer is discharged from the developer discharge port despite that the amount of developer is lower than the appropriate amount, the amount of developer within the developing device might fall below the required amount, destabilizing the supply of the developer to a latent image carrier. If the supply of the developer to the latent image carrier is destabilized, image omission and other abnormal images occur.

Such problems are not limited to a developing device that uses a two-component developer, and thus might occur in any developing device that uses a one-component developer, as long as such a developing device is configured such that a developer is replenished by developer replenishing means and then the increment of the developer within the developing device is discharged by developer discharge means.

Technologies relating to the present invention are also disclosed in, e.g., Japanese Unexamined Patent Application No. H05-127537, Japanese Unexamined Patent Application No. H11-007195, Japanese Unexamined Patent Application No. H11-024382, Japanese Unexamined Patent Application No. 2000-047474, and Japanese Patent Application No. 2,891,845.

SUMMARY OF THE INVENTION

The present invention was contrived in view of the above problems, and an object of the present invention is to provide a developing device capable of stably supplying a developer to a latent image carrier by preventing the scattered developer from being discharged despite that the amount of developer within the developing device does not increase, and to also provide an image forming apparatus using the developing device.

In an aspect of the present invention, a developing device comprises a developer carrier, which rotates while carrying a developer on a surface thereof, supplies a toner to a latent image on a surface of a latent image carrier at a section where the developer carrier faces the latent image carrier, and develops the latent image; a developer conveyance path, which has a developer conveying member conveying the developer, and conveys the developer while supplying the developer to the developer carrier in a developer supply region in which the developer is supplied to the developer carrier; a developer replenishing device for replenishing the developer to the developer conveyance path; a developer discharge port which is provided in the developer conveyance path and which discharges the developer to the outside of the developing device, at a predetermined height level of a position in which the bulk of the developer increases or decreases as the amount of developer within the entire developer conveyance path increases or decreases; and a scattered developer discharge prevention member, which blocks a path through which the developer scattered as a result of a conveyance operation of the developer conveying member moves toward the developer discharge port.

In another aspect of the present invention, a developing device comprises a developer carrier, which rotates while carrying a developer on a surface thereof, supplies a toner to a latent image on a surface of a latent image carrier at a section where the developer carrier faces the latent image carrier, and develops the latent image; a developer conveyance path, which has a developer conveying member conveying the developer, and conveys the developer while supplying the developer to the developer carrier in a developer supply region in which the developer is supplied to the developer carrier; and a developer discharge port which is provided in the developer conveyance path and which discharges the developer to the outside of the developing device, at a predetermined height level of a position in which the bulk of the developer increases or decreases as the amount of developer within the entire developer conveyance path increases or decreases. The developer conveying member is a developer conveying screw that has a rotation axis and a wing portion provided in a spiral form on the rotation axis, and conveys the developer in a direction of the rotation axis by rotating, and a conveying force of the wing portion within a developer discharge region provided with the developer discharge port is smaller than a conveying force of the wing portion positioned on an upstream side in a developer discharge direction of the developer discharge region.

In another aspect of the present invention, an image forming apparatus comprises at least a latent image carrier a charging device for charging the surface of the latent image carrier; a latent image forming device for forming an electrostatic latent image on the latent image carrier; and a developing device for developing the electrostatic latent image to form a toner image. The developing device has a developer carrier, which rotates while carrying a developer on a surface thereof, supplies a toner to a latent image on a surface of a latent image carrier at a section where the developer carrier faces the latent image carrier, and develops the latent image; a developer conveyance path, which has a developer conveying member conveying the developer, and conveys the developer while supplying the developer to the developer carrier in a developer supply region in which the developer is supplied to the developer carrier; a developer replenishing device for replenishing the developer to the developer conveyance path; a developer discharge port which is provided in the developer conveyance path and which discharges the developer to the outside of the developing means, at a predetermined height level of a position in which the bulk of the developer increases or decreases as the amount of developer within the entire developer conveyance path increases or decreases; and a scattered developer discharge prevention member, which blocks a path through which the developer scattered as a result of a conveyance operation of the developer conveying member moves toward the developer discharge port.

BRIEF DESCRIPTION OF THE DRAWINGS

The above and other objects, features and advantages of the present invention will become more apparent from the following detailed description taken with the accompanying drawings, in which.

DESCRIPTION OF THE PREFERRED EMBODIMENT(S)

Embodiment 1

As an image forming apparatus to which the present invention is applied, an embodiment (simply referred to as "Embodiment 1" hereinafter) of a tandem color laser copying machine (simply called "copying machine" hereinafter) in which a plurality of photoreceptors are disposed in parallel with each other will be described below.

Figure 1:
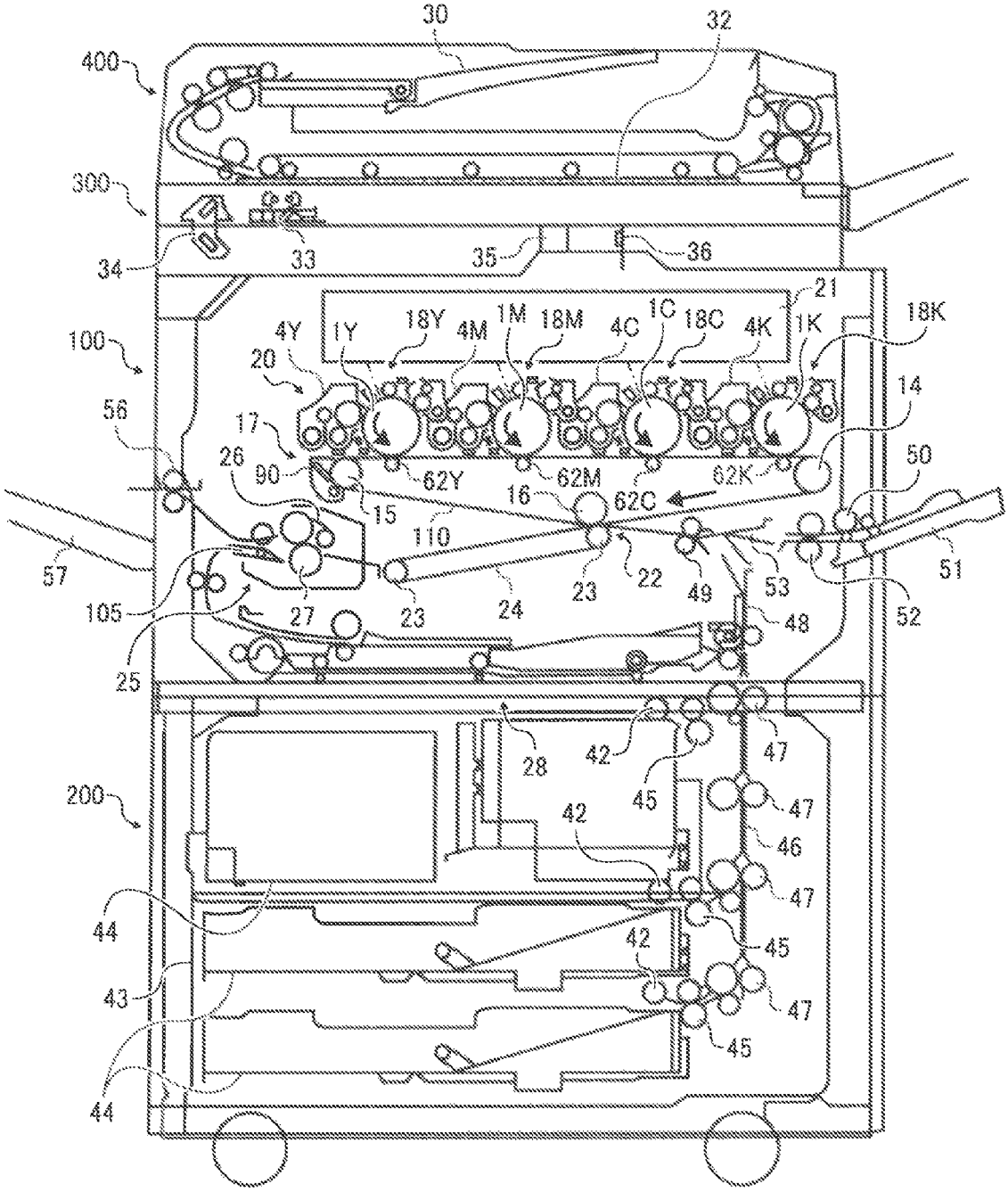
FIG. 1 is a view showing a schematic configuration of a copying machine according to Embodiment 1 of the present invention.

FIG. 1 shows a schematic configuration of the copying machine according to Embodiment 1. This copying machine has a printer portion 100, a sheet feeding device 200 on which the printer portion is placed, a scanner 300 placed fixedly on the printer portion 100, and the like. The copying machine also has an automatic original conveying device 400 that is placed fixedly on the scanner 300.

The printer portion 100 has an image forming unit 20 that is constituted by four process cartridges 18Y, M, C and K for forming images of colors of yellow (Y), magenta (M), cyan (C), and black (K) respectively. Y, M, C and K provided at the ends of the reference numerals indicate the members for the colors, yellow, cyan, magenta and black, respectively (same hereinafter). An optical writing unit 21, an intermediate transfer unit 17, a secondary transfer device 22, a resist roller pair 49, a belt fixing type fixing device 25 and the like are disposed besides the process cartridges 18Y, M, C and K.

The optical writing unit 21 has a light source, a polygon mirror, an f-θ lens, a reflecting mirror and the like, not shown, and emits a laser beam onto the surface of an after-described photoreceptor on the basis of image data.

Each of the process cartridges 18Y, M, C and K has a drum-like photoreceptor 1, a charging unit, a developing device 4, a drum cleaning device, a destaticizing unit, and the like.

The yellow process cartridge 18 will be described hereinafter.

The surface of a photoreceptor 1Y is uniformly charged by the charging unit functioning as charging means. The surface of the photoreceptor 1Y that is subjected to charging processing is irradiated with a laser beam that is modulated and deflected by the optical writing unit 21. Consequently, the potential of the irradiated portion (exposed portion) is attenuated. Due to this attenuation, a Y electrostatic latent image is formed on the surface of the photoreceptor 1Y. The formed Y electrostatic latent image is developed by a developing device 4Y serving as developing means, whereby a Y toner image is obtained.

The Y toner image formed on the Y photoreceptor 1Y is primarily transferred to an intermediate transfer belt 110 described hereinafter. Transfer residual toner on the surface of the photoreceptor 1Y is cleaned by the drum cleaning device after the Y toner image is primarily transferred.

In the Y process cartridge 18Y, the photoreceptor 1Y that is cleaned by the drum cleaning device is destaticized by the destaticizing unit. Then, the photoreceptor 1Y is uniformly charged by the charging unit and thereby returns to the initial state. The series of processes described above is the same for the other process cartridges 18M, C and K.

The intermediate transfer unit will be described next.

The intermediate transfer unit 17 has the intermediate transfer belt 110, a belt cleaning device 90 and the like. The intermediate transfer unit 17 further has a stretching roller 14, a drive roller 15, a secondary transfer backup roller 16, four primary transfer bias rollers 62Y, M, C and K, and the like.

The intermediate transfer belt 110 is tension-stretched by a plurality of rollers including the stretching roller 14. The intermediate transfer belt 110 is then moved endlessly in a clockwise direction in the drawing by rotation of the drive roller 15 that is driven by a belt drive motor, not shown.

Each of the four primary transfer bias rollers 62Y, M, C and K is disposed in contact with the inner peripheral surface of the intermediate transfer belt 110, and is applied with a primary transfer bias from a power source, not shown. Furthermore, the inner peripheral surface of the intermediate transfer belt 110 is pressed against the photoreceptors 1Y, M, C and K to form primary transfer nips. At each of the primary transfer nips, a primary transfer electric field is formed between each photoreceptor and each primary transfer bias roller due to the influence of the primary transfer bias.

The abovementioned Y toner image formed on the Y photoreceptor 1Y is primarily transferred onto the intermediate transfer belt 110 due to the influence of the primary transfer electric field or nip pressure. M, C and K toner images formed on the M, C and K photoreceptors 1M, C and K are sequentially superimposed and primarily transferred onto the Y toner image. A four-color superimposed toner image (called "four-color toner image" hereinafter), i.e., the multiple toner image, is formed on the intermediate transfer belt 110 due to the primary transfer performed by superimposing the toner images.

The four-color toner image that is transferred onto the intermediate transfer belt 110 is secondarily transferred onto a transfer sheet, i.e., a recording medium that is not shown, by a secondary transfer nip described hereinafter. The residual transfer toner that remains on the surface of the intermediate transfer belt 110 after the developer passes through the secondary transfer nip is cleaned by the belt cleaning device 90 that holds the belt between this belt cleaning device and the drive roller 15 located on the left side of the drawing.

Next, the secondary transfer device 22 will be described.

The secondary transfer device 22 that stretches a sheet conveying belt 24 by means of two stretching rollers 23 is disposed on the lower side of the intermediate transfer unit 17 as shown. The sheet conveying belt 24 is endlessly moved in a counterclockwise direction in the drawing as at least either one of the stretching rollers 23 is driven and rotated. Of the two stretching rollers 23, the one roller disposed on the right side in the drawing holds the intermediate transfer belt 110 and the sheet conveying belt 24 between the stretching roller and the secondary backup roller 16 of the intermediate transfer unit 17. Accordingly, the secondary transfer nip where the intermediate transfer belt 110 of the intermediate transfer unit 17 comes into contact with the sheet conveying belt 24 of the secondary transfer device 22 is formed. Then, this stretching roller 23 is applied with a secondary transfer bias having a polarity opposite to the polarity of the toner, by the unshown power source. Due to this application of the secondary transfer bias, a secondary transfer electric field that electrostatically moves the four-color toner image formed on the intermediate transfer belt 110 of the intermediate transfer unit 17 from the belt side toward this stretching roller 23 is formed at the secondary transfer nip. The four-color toner image that is affected by the secondary transfer electric field or nip pressure is secondarily transferred onto the transfer sheet which is sent to the secondary transfer nip by the after-described resist roller pair 49 in synchronization with the four-color toner image formed on the intermediate transfer belt 110. It should be noted that a charger for charging the transfer sheet in a noncontact manner may be provided in place of the secondary transfer system that applies a secondary transfer bias to this stretching roller 23.

In the sheet feeding device 200 provided in a lower section of the copying machine main body, a plurality of sheet feeding cassettes 44, each of which can contain a plurality of stacked transfer sheets, are disposed vertically in a stacked manner. Each of the sheet feeding cassettes 44 presses the top transfer sheet of the stacked transfer sheets against a sheet feeding roller 42. Then, by rotating the sheet feeding roller 42, the top transfer sheet is sent out toward a sheet feeding path 46.

The sheet feeding path 46 that receives the transfer sheet sent out from the sheet feeding cassette 44 has a plurality of conveying roller pairs 47 and the resist roller pair 49 that is provided in the vicinity of an end of the sheet feeding path. The sheet feeding path 46 conveys the transfer sheet toward the resist roller pair 49. The transfer sheet conveyed toward the resist roller pair 49 is sandwiched between the roller portions of the resist roller pair 49. On the other hand, in the intermediate transfer unit 17, the four-color toner image formed on the intermediate transfer belt 110 enters the secondary transfer nip as the belt endlessly moves. The resist roller pair 49 sends the transfer sheet sandwiched between the roller portions at timing at which the transfer sheet is attached to the four-color toner image at the secondary transfer nip. In this manner, the four-color toner image formed on the intermediate transfer belt 110 is attached to the transfer sheet at the secondary transfer nip. Then, the four-color toner image is secondarily transferred onto the transfer sheet and thereby becomes a full-color image on the white transfer sheet. The transfer sheet on which the full-color image is formed in this manner leaves the secondary transfer nip as the sheet conveying belt 24 endlessly moves, and is then sent from the top of the sheet conveying belt 24 to the fixing device 25.

The fixing device 25 has a belt unit that is caused to move endlessly while stretching a fixing belt 26 by means of two rollers, and a pressure roller 27 that is pressed against one of the rollers of the belt unit. The fixing belt 26 and the pressure roller 27 abut against each other to form a fixing nip, and the transfer sheet received from the sheet conveying belt 24 is sandwiched by this nip. Of the two rollers of the belt unit, the roller that is pressed by the pressure roller 27 has a heat source therein, not shown, and applies pressure on the fixing belt 26 by using heat generated by the heat source. The fixing belt 26 applied with pressure then heats the transfer sheet sandwiched by the fixing nip. Due to the application of heat or the nip pressure, the full-color image is fixed onto the transfer sheet.

The transfer sheet that is subjected to fixing processing in the fixing device 25 is either stacked on a stack portion 57 provided outside of a plate of a printer casing on the left side of the drawing, or is returned to the abovementioned secondary transfer nip in order to form a toner image on the other side of the transfer sheet.

When making a copy of an original, not shown, for example, a sheaf of sheet originals is set on an original platen 30 of the automatic original conveying device 400. However, if this original is a one-filing original closed by the subject document, the sheaf of sheet originals is set on a contact glass 32. Prior to this setting operation, the automatic original conveying device 400 is opened with respect to the copying machine main body, and thereby the contact glass 32 of the scanner 300 is exposed. Thereafter, the one-filing original is pressed by the closed automatic original conveying device 400.

After the original is set in this manner, an unshown copy start switch is pressed, whereby original reading operation is performed by the scanner 300. However, if a sheet original is set on the automatic original conveying device 400, the automatic original conveying device 400 automatically moves the sheet original to the contact glass 32 before the original reading operation is performed. When the original reading operation is performed, a first traveling body 33 and a second traveling body 34 start traveling together first, and light is emitted from a light source provided in the first traveling body 33. Then, the light reflected from the surface of the original is reflected by a mirror provided within the second traveling body 34, passes through an image forming lens 35, and thereafter enters a read sensor 36. The read sensor 36 constructs image information based on the reflected light.

In parallel with such original reading operation, each element within each of the process cartridges 18Y, M, C and K, the intermediate transfer unit 17, the secondary transfer device 22, and the fixing device 25 start driving. Then, the optical writing unit 21 is driven and controlled based on the image information constructed by the read sensor 36, and Y, M, C and K toner images are formed on the photoreceptors 1Y, M, C and K respectively. These toner images become a four-color toner image by superimposing and transferring these toner images on the intermediate transfer belt 110.

Moreover, at substantially the same time as when the original reading operation is performed, a sheet feeding operation is started in the sheet feeding device 200. In this sheet feeding operation, one of the sheet feeding rollers 42 is selected and rotated, and transfer sheets are sent out from one of the sheet feeding cassettes 44 that are stored in multiple stages in a sheet bank 43. The sent transfer sheets are separated one by one by a separating roller 45. Each sheet enters a reversal sheet feeding path 46 and is then conveyed to the secondary transfer nip by the conveying roller pairs 47. Sheets are sometimes fed from a manual tray 51 in place of the sheet feeding cassettes 44. In this case, after a manual sheet feeding roller 50 is selected and rotated to send out transfer sheets placed on the manual tray 51, the separation roller 52 separates the transfer sheets one by one and feeds each sheet to a manual sheet feeding path 53 of the printer portion 100.

In the present copying machine, when forming other color image composed of toners of two or more colors, the intermediate transfer belt 110 is stretched such that an upper stretching surface thereof lies substantially horizontally, and all of the photoreceptors 1Y, M, C and K are brought into contact with the upper stretching surface. On the other hand, when forming a monochrome image composed of the K toner only, the intermediate transfer belt 110 is tilted downward to the left in the drawing by using an unshown mechanism, and the upper stretching surface is separated from the Y, M and C photoreceptors 1Y, M and C. Then, out of the four photoreceptors 1Y, M, C and K, only the K photoreceptor 1K is rotated in the counterclockwise direction in the drawing to form a K toner image only. At this moment, for Y, M and C, driving of the photoreceptors 1 thereof and a developing unit is stopped to prevent the photoreceptors and developer from being depleted unnecessarily.

The present copying machine has a control unit, not shown, which is configured by a CPU and the like that control the following elements within the copying machine, and an operation display portion, not shown, which is configured by a liquid crystal display, various keybuttons, and the like. An operator can select one of three one-side printing modes for forming an image on one side of a transfer sheet, by sending a command to the control unit based on the implementation of a key input operation in the operation display portion. The three one-side printing modes are a direct discharge mode, a reversal discharge mode, and a reversal decal discharge mode.

Figure 2:
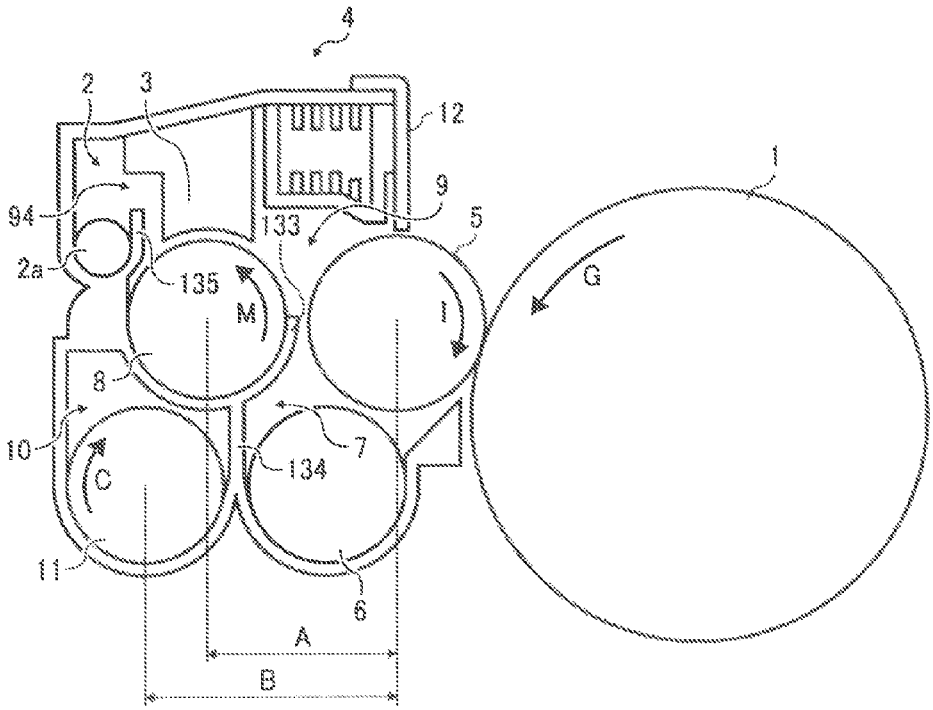
FIG. 2 is a view showing schematic configurations of a developing device and a photoreceptor of the copying machine.

FIG. 2 shows the developing device 4 provided in one of the four process cartridges 18Y, M, C and K and the photoreceptor 1. Apart from the fact that they handle different colors, the configurations of the four process cartridges 18Y, M, C and K are essentially identical and, accordingly, the letters Y, M, C and K applied to the "4" of the drawing have been omitted.

The surface of the photoreceptor 1 is charged by the charging device, not shown, as it rotates in the direction of the arrow G in the drawing shown in FIG. 2. Toner is supplied from the developing device 4 to a latent image formed as an electrostatic latent image on the surface of the charged photoreceptor 1 by a laser beam irradiated from an exposure device, not shown, to form a toner image.

The developing device 4 has a developing roller 5 that serves as a developer carrier for supplying the toner to develop the latent image on the surface of the photoreceptor 1 while surface-moving in the direction of the arrow I of the drawing. The developing device 4 also has a supply screw 8 serving as a supply conveying member for, while supplying the developer to the developing roller 5, conveying the developer in the direction toward the far side of FIG. 2. The supply screw 8 is a developer conveying screw that has a rotation axis and a wing portion provided on this rotation axis, and conveys the developer in the axial direction by rotating.

A development doctor 12 serving as a developer regulating member for regulating the thickness of the developer supplied to the developing roller 5 to a thickness suitable for development is provided on the downstream side in the direction of surface movement of the developing roller 5 from a part facing the supply screw 8.

A recovery screw 6 serving as a recovery conveying member for recovering the developer that has passed through the developing portion and used for development and for carrying the recovered recovery developer in the same direction as the direction of the supply screw 8 is provided on the downstream side in the direction of surface movement of the developing roller 5 from the developing portion which constitutes a part facing the photoreceptor 1. A supply conveyance path 9 having the supply screw 8 is disposed in the lateral direction of the developing roller 5, and a recovery conveyance path 7 serving as a recovery conveyance path having the recovery screw 6 is disposed in parallel below the developing roller 5.

A stirring conveyance path 10 is provided in the developing device 4 in parallel with the recovery conveyance path 7 below the supply conveyance path 9. The stirring conveyance path 10 has a stirring screw 11 serving as a stirring/conveying member for, while stirring the developer, conveying it in the opposite direction to the direction of the supply screw 8, the opposite direction being oriented on the near side in the drawing.

The supply conveyance path 9 and the stirring conveyance path 10 are partitioned by a first partition wall 133 serving as a partition member. An opening portion is formed in part of the first partition wall 133 that partitions the supply conveyance path 9 and the stirring conveyance path 10 at both ends in the near side and far side of the drawing to connect the supply conveyance path 9 and the stirring conveyance path 10 to each other.

Note that the supply conveyance path 9 and the recovery conveyance path 7 are also partitioned by the first partition wall 133, but there is no opening portion provided in the part where the first partition wall 133 partitions the supply conveyance path 9 and the recovery conveyance path 7.

The two conveyance paths of the stirring conveyance path 10 and the recovery conveyance path 7 are also partitioned by a second partition wall 134 serving as a partition member. An opening portion is formed in the second partition wall 134 at the near side in the drawing to connect the stirring conveyance path 10 and the recovery conveyance path 7 to each other.

The supply screw 8, the recovery screw 6 and the stirring screw 11 serving as the developer conveying members are made of resin or metal. The diameter of each screw is set to ϕ22 [mm]. The supply screw has a screw pitch of 50 [mm] in the form of a double winding, and the recovery screw 6 and the stirring screw 11 each has a screw pitch of 25 [mm] in the form of a single winding. The revolution speed of each screw is set to 600 [rpm].

The developer that is thinned by the stainless developing doctor 12 on the developing roller 5 is conveyed to a developing region facing the photoreceptor 1, to perform development. The surface of the developing roller 5 made of an Al or SUS pipe stock with a diameter of ϕ25 [mm] has a V-shaped groove or is sandblasted. The size of the gap formed between the developing doctor 12 and the photoreceptor 1 is approximately 0.3 [mm].

The developer obtained after development is recovered by the recovery conveyance path 7, then conveyed to the near side of the cross section of FIG. 2, and then transferred to the stirring conveyance path 10 at the opening portion of the first partition wall 133 provided in a non-image region. It should be noted that toner is replenished from a toner replenishing opening provided above the stirring conveyance path 10 to the stirring conveyance path 10, in the vicinity of the opening portion of the first partition wall 133 on the upstream side in the developer conveyance direction in the stirring conveyance path 10.

Next, the circulation of the developer within the three developer conveyance paths will be described.

Figure 3:
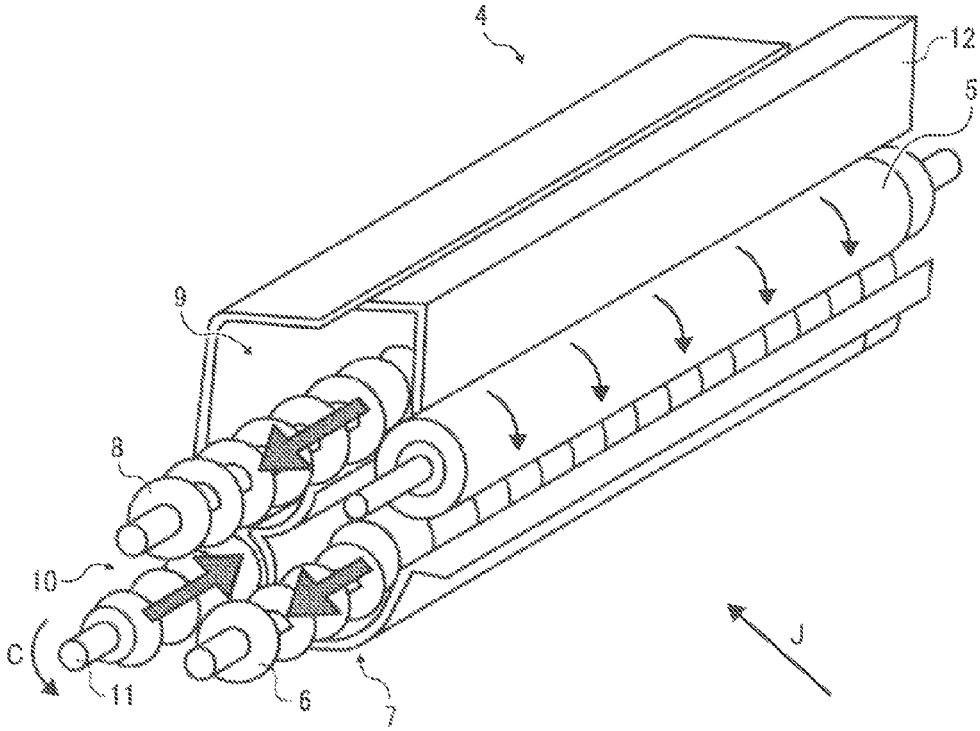
FIG. 3 is an external perspective sectional view showing a part of the developing device to explain a flow of a developer.

FIG. 3 shows a flow of the developer within the developer conveyance paths. The arrows in the drawing indicate the directions of movement of the developer.

Figure 4:
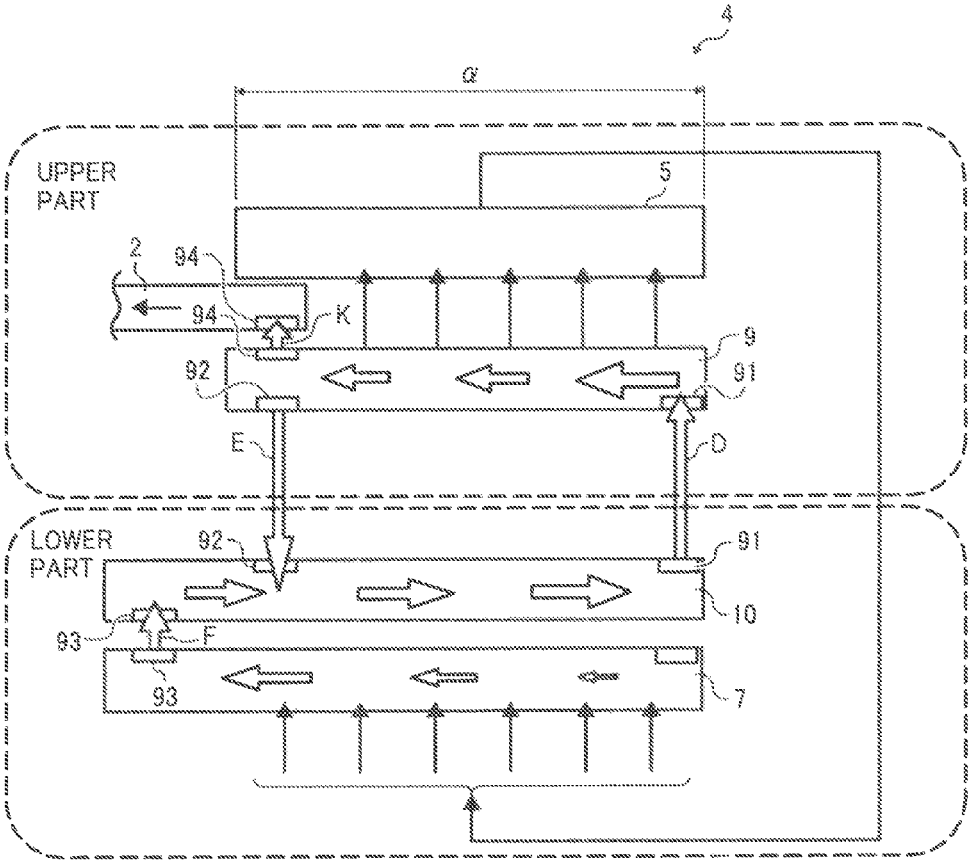
FIG. 4 is a schematic diagram showing the flow of the developer within the developing device.

Also, FIG. 4 shows a flow of the developer within the developing device 4. As with FIG. 3, the arrows in the diagram indicate the directions of movement of the developer.

In the supply conveyance path 9 to which the developer is supplied from the stirring conveyance path 10, the developer is conveyed to the downstream side in the direction of conveyance of the supply screw 8, while being supplied to the developing roller 5. Excess developer that is supplied to the developing roller 5 and conveyed to a downstream end in the direction of conveyance of the supply conveyance path 9 without being used in development is supplied to the stirring conveyance path 10 through an excess opening portion 92 of the first partition wall 133 (arrow E in FIG. 4).

The recovery developer that is fed from the developing roller 5 to the recovery conveyance path 7 and conveyed to the downstream end in the direction of conveyance of the recovery conveyance path 7 by the recovery screw 6 is supplied to the stirring conveyance path 10 through a recovery opening portion 93 of the second partition member 134 (arrow F in FIG. 4).

The stirring conveyance path 10 stirs the supplied excess developer and recovery developer, conveys thus obtained mixture to the upstream side in the direction of conveyance of the supply screw 8, which constitutes the downstream side in the direction of conveyance of the stirring screw 11, and supplies it to the supply conveyance path 9 through a supply opening portion 91 of the first partition wall 133 (arrow D in FIG. 4).

In the stirring conveyance path 10, the recovery developer, excess developer, and toner replenished from a transporting portion according to need are stirred and conveyed in the direction opposite to that of the developer of the recovery path 7 and the supply path 9, by means of the stirring screw 11. The stirred developer is transported to the upstream side in the direction of conveyance of the supply conveyance path 9 that is communicated at the downstream side in the direction of conveyance. Note that a toner density sensor, not shown, is provided below the stirring conveyance path 10, and a toner replenishment control device, not shown, is actuated by the output of the sensor so that the toner is replenished from a toner containing portion, not shown.

In the developing device 4 shown in FIG. 4 having the supply conveyance path 9 and the recovery conveyance path 7, because the developer is supplied and recovered in different developer conveyance paths, the developer used for development is prevented from being mixed in the supply conveyance path 9. Accordingly, the toner density of the developer supplied to the developing roller 5 is prevented from decreasing as the developer is sent toward the downstream side in the direction of conveyance of the supply conveyance path 9. In addition, because the developing device has the recovery conveyance path 7 and the stirring conveyance path 10 and the developer is recovered and stirred in different developer conveyance paths, loss of the developer used in development while it is being stirred is prevented. Accordingly, because the insufficiently stirred developer is supplied to the supply conveyance path 9, insufficient stirring of the developer to be supplied to the supply conveyance path 9 can be prevented. Because the toner density of the developer of the supply conveyance path 9 is prevented from decreasing and insufficient stirring of the developer in the supply conveyance path 9 is prevented in this manner, a constant image density can be ensured throughout development.

As shown in FIG. 4, the developer is moved from the lower part of the developing device 4 to the upper part of the same in the direction of the arrow D only. The developer is moved in the direction of the arrow D to raise the developer and supply the developer to the supply conveyance path 9 by pushing the developer using the rotation of the stirring screw 11.

Such movement of the developer causes stress on the developer, reducing the life of the developer.

When the developer is lifted up as described above, stress is placed on the developer, whereby scraping of a carrier film and toner spending occur at the stressed part of the developer, and consequently stable image quality can no longer be maintained.

Therefore, the life of the developer can be extended by alleviating the stress that is placed on the developer when the developer is moved in the direction of the arrow D. By extending the life of the developer, it becomes possible to provide a developing device capable of preventing the developer from being degraded and capable of providing stable image quality with no image density irregularity.

In the developing device 4 of this Embodiment 1, the supply conveyance path 9 is disposed obliquely upward on the stirring conveyance path 10, as shown in FIG. 2. By disposing the supply conveyance path 9 obliquely upward, the stress placed on the developer when moving the developer in the direction of the arrow D can be alleviated more as compared with the case in which the supply conveyance path 9 is provided directly above the stirring conveyance path 10 to lift up the developer.

Furthermore, in the developing device 4, the supply conveyance path 9 and the stirring conveyance path 10 are disposed obliquely, thereby an upper wall surface of the stirring conveyance path 10 is disposed higher than a lower wall surface of the supply conveyance path 9 as shown in FIG. 2.

When the supply conveyance path 9 is lifted up in a direction perpendicular to the stirring conveyance path 10, the developer is lifted up by the pressure of the stirring screw 11 against gravitational force, and thus stress is placed on the developer. However, by disposing the upper wall surface of the stirring conveyance path 10 to be higher than the lower wall surface of the supply conveyance path 9, the developer existing at the uppermost point of the stirring conveyance path 10 can flow into the lowermost point of the supply conveyance path 9 without fighting gravity, and thus the stress placed on the developer can be reduced.

It should be noted that a fin member may be provided on the axis of the stirring screw 11, which is a section where the stirring conveyance path 10 and the supply conveyance path 9 are communicated with each other on the downstream side of the developer conveyance path of the stirring conveyance path 10. This fin member is a plate-like member configured by a side parallel to the axial direction of the stirring screw 11 and a side perpendicular to the axial direction of the stirring screw. By scooping up the developer using the fin member, the developer can be delivered efficiently from the stirring conveyance path 10 to the supply conveyance path 9.

Moreover, in the developing device 4 the supply conveyance path 9 and the stirring conveyance path 10 are disposed such that the center distance A between the developing roller 5 and the supply conveyance path 9 is shorter than the center distance B between the developing roller 5 and the stirring conveyance path 10. In this manner, the developer can be supplied from the supply conveyance path 9 to the developing roller 5 naturally, and the size of the apparatus can be reduced.

In addition, the stirring screw 11 rotates in the counterclockwise direction as viewed from the near side of FIG. 2 (direction of the arrow C in the drawing), so that the developer is lifted up along the shape of the stirring screw 11 and transported to the supply conveyance path 9. Accordingly, the developer can be lifted up efficiently, and also the stress placed thereon can be reduced.

Figure 5:
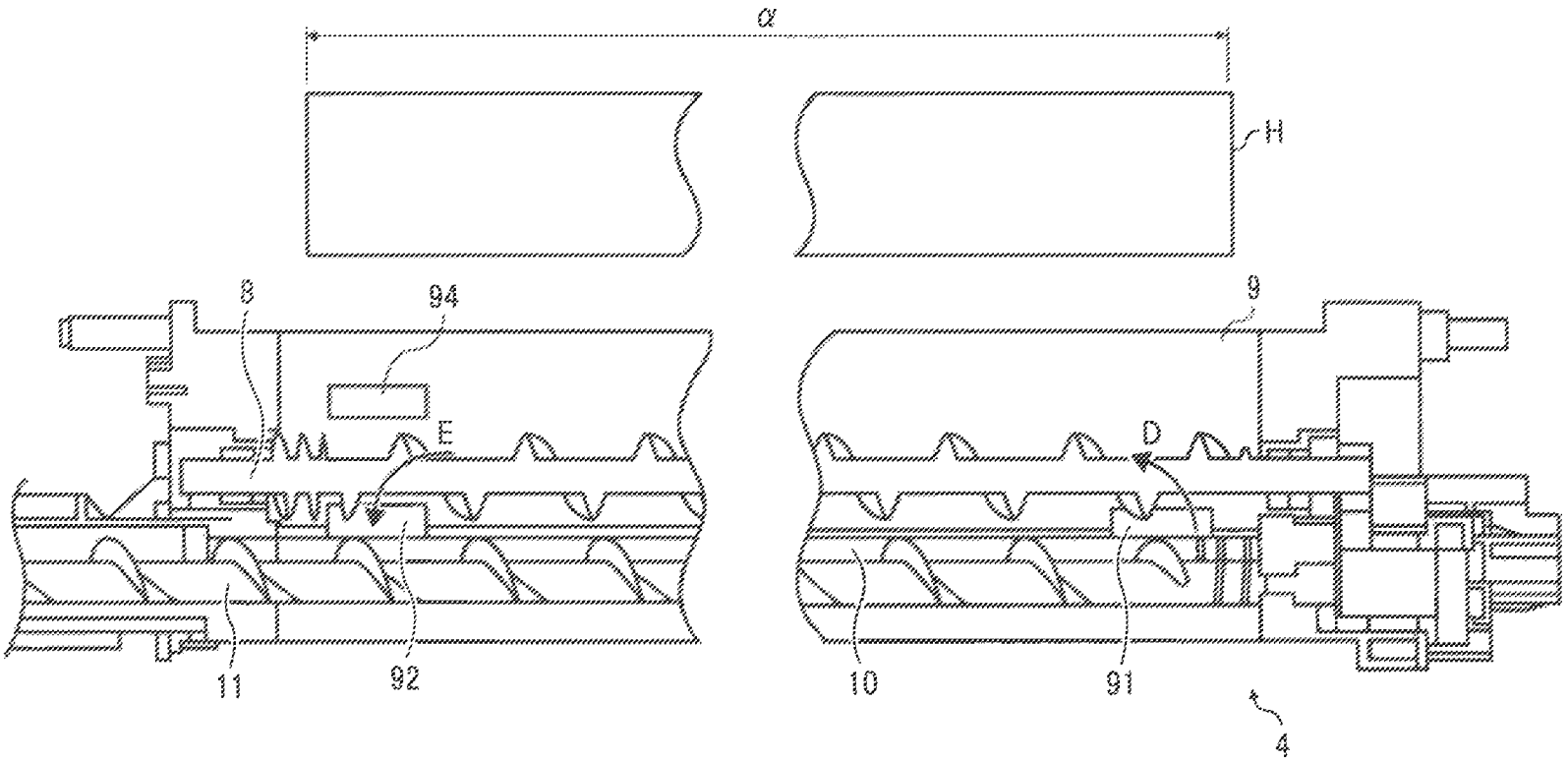
FIG. 5 is a cross-sectional view showing the configuration of the developing device.

FIG. 5 is a cross-sectional view of the rotation center of the supply screw 8 of the developing device 4, the rotation center being viewed in the direction of the arrow J shown in FIG. 3. Reference numeral H in the drawing shows a developing region in which the developing roller 5 serving as the developer carrier supplies the toner to the photoreceptor 1 serving as the latent image carrier. The width of the developing region H in the direction of rotation axis of the developing roller 5 is the developing region width $\alpha$.

As shown in FIG. 5, the developing device 4 is provided with, within the developing region width $\alpha$, the supply opening portion 91 for lifting up the developer from the stirring conveyance path 10 to the supply conveyance path 9, and the excess opening portion 92 for dropping the developer from the supply conveyance path 9 to the stirring conveyance path 10.

Figure 6:
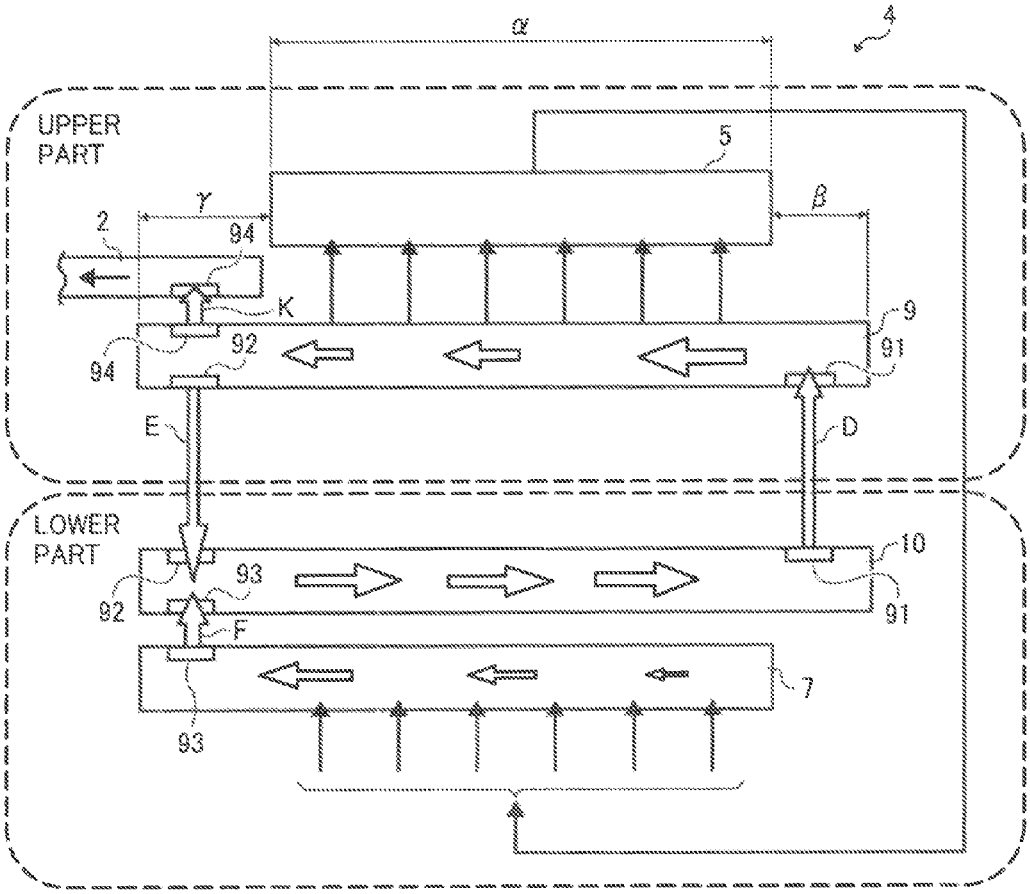
FIG. 6 is a schematic diagram showing a flow of the developer within a developing device having a shape different from that shown in FIG. 4.

FIG. 6 shows a flow of the developer within the developing device 4 having a different configuration from the developing device shown in FIG. 4.

In the developing device 4 shown in FIG. 6, the supply opening portion 91 and the excess opening portion 92 are provided outside the developing region width $\alpha$. Because the supply opening portion 91 is provided outside the developing region width $\alpha$, the upstream side in the conveyance direction of the supply conveyance path 9 is longer than the developing roller 5 by a supply conveyance path upstream region $\beta$. Also, because the excess opening portion 92 is provided outside the developing region width $\alpha$, the downstream side in the conveyance direction of the supply conveyance path 9 is longer than the developing roller 5 by a supply conveyance path downstream region $\gamma$.

On the other hand, in the developing device 4 with the configuration shown in FIG. 4, because the supply opening portion 91 is provided within the developing region width $\alpha$, the upstream side in the conveyance direction of the supply conveyance path 9 can be made shorter than the developing device 4 shown in FIG. 6 by the supply conveyance path upstream region $\beta$. Moreover, because the excess opening portion 92 is provided within the developing region width $\alpha$, the downstream side in the conveyance direction of the supply conveyance path 9 can be made shorter than the developing device 4 shown in FIG. 6 by the supply conveyance path downstream region $\gamma$.

Because the supply opening portion 91 and the excess opening portion 92 of the developing device 4 shown in FIG. 4 are provided within the developing region width $\alpha$ as described above, the space of the upper part of the developing device 4 can be saved more, as compared with the developing device 4 shown in FIG. 6.

Figure 7:
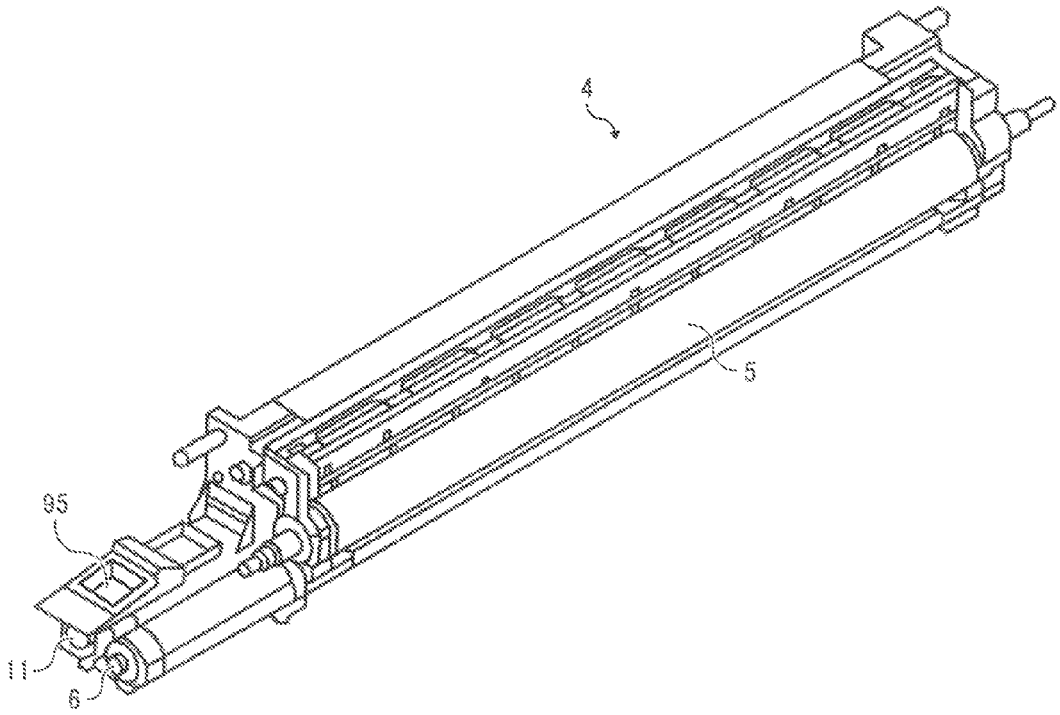
FIG. 7 is an external perspective view showing the configuration of the developing device.

Next is described the position where the toner is replenished to the developer conveyance paths constituted by the supply conveyance path 9, the stirring conveyance path 10 and the recovery conveyance path 7 of the developing device 4. FIG. 7 shows the exterior of the developing device 4.

As shown in FIG. 7, the toner replenishing port 95 for replenishing the toner is provided above an upstream end portion in the conveyance direction of the stirring conveyance path 10 having the stirring screw 11. Because this toner replenishing port 95 is provided on the outer side than the end portion in the width direction of the developing roller 5, it is positioned outside the developing region width α.

The section provided with the toner replenishing port 95 is an extension of the conveyance direction of the supply conveyance path 9, and corresponds to an empty space of the supply conveyance path downstream region γ shown in FIG. 6. By providing the toner replenishing port 95 in the empty space obtained by providing the excess opening portion 92 within the developing region width α, the size of the developing device 4 can be reduced.

The toner replenishing port 95 may be provided not only above the upstream end portion in the conveyance direction of the stirring conveyance path 10, but also above a downstream end portion of the recovery conveyance path 7.

Moreover, the toner replenishing port 95 may be provided immediately above the recovery opening portion 93, which is a section where the developer is delivered from the recovery conveyance path 7 to the stirring conveyance path 10. The space immediately above the recovery opening portion 93 is also the empty space obtained by providing the excess opening portion 92 within the developing region width α, and thus the size of the developing device 4 can be reduced by providing the toner replenishing port 95 at this position. Moreover, in the recovery opening portion 93 serving as the delivery portion, the developer is easily mixed, and thus the developer can be stirred more efficiently by performing replenishment at this position.

As in the developing device 4 described with reference to FIG. 4, there are provided within the developing region width α the supply opening portion 91 for delivering the developer from the downstream end in the conveyance direction of the stirring conveyance path 10 to the upstream end in the conveyance direction of the supply conveyance path 9, and the excess opening portion 92 for delivering the developer from the downstream end of the supply conveyance path 9 to the upstream end in the conveyance direction of the stirring conveyance path 10. Therefore, as compared with the conventional developing device 4, the space in the upper part of the developing device 4 can be saved, and the spaces in the entire developing device 4 can be also saved.

Moreover, the toner replenishing port 95 is provided in the empty space that is obtained by providing the excess opening portion 92 within the developing region width α, and thus the size of the developing device 4 can be reduced.

Because the toner is replenished from the upper part of the recovery opening portion 93 serving as a delivery portion for delivering the developer from the recovery conveyance path 7 to the stirring conveyance path 10, the developer can be stirred efficiently.

In addition, the developing device 4 is provided as the developing means of the printer portion 100 of the copying machine, i.e. the image forming apparatus, and thus the spaces of the entire apparatus can be saved.

Next, the replacement of the developer in the developing device 4 will be described.

The toner replenishment control device, not shown, which serves as the developer replenishing means, replenishes the toner stored in the toner container, not shown, from the toner replenishing port 95 to the developing device 4. In the developing device 4 of Embodiment 1, the developer having toner and carrier is replenished from the toner replenishing port 95 of the developing device 4. Hereinafter, the developer having a mixture of toner and carrier and replenished to the developing device 4 is referred to as "premixed toner."

Also, the supply conveyance path 9 has a developer discharge port 94 for discharging some of the developer within the supply conveyance path 9 to the outside of the developing device 4 when the developer bulk exceeds a predetermined bulk, and a discharge conveyance path 2 that has a discharge conveying screw 2*a* for conveying the developer discharged from the developer discharge port 94, to the outside of the developing device 4. The discharge conveyance path 2 is disposed on the downstream side in the conveyance direction of the supply conveyance path 9 such as to be adjacent to the supply conveyance path 9 with a partition wall 135 therebetween. The developer discharge port 94 is an opening provided on the partition wall 135 such that the supply conveyance path 9 and the discharge conveyance path 2 are communicated with each other.

Next, the conventional developing device 4 having the developer discharge port 94 will be described.

Figure 22:
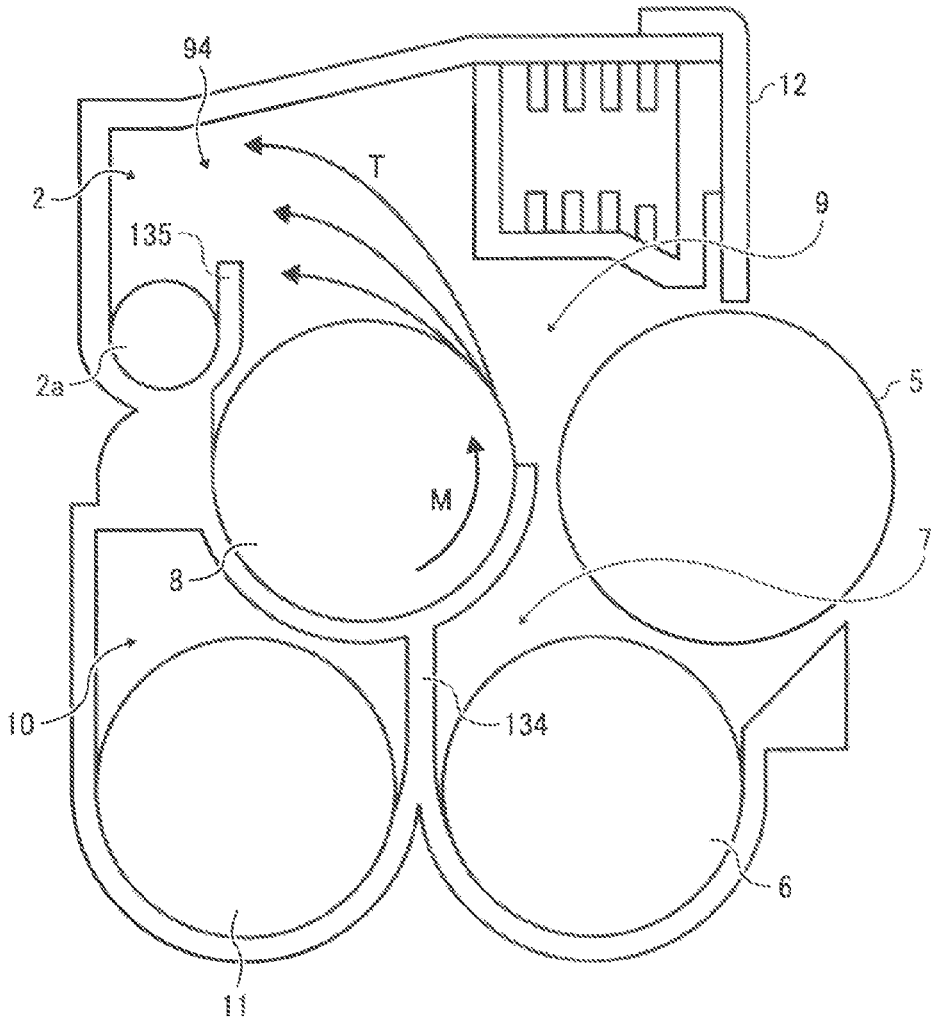
FIG. 22 PRIOR ART
FIG. 22 is a cross-sectional view showing the configuration of the conventional developing device having a developer discharge port.

FIG. 22 shows the configuration of the vicinity of the downstream end in the conveyance direction of the supply conveyance path 9 of the conventional developing device 4 having the developer discharge port 94, the developing device 4 being viewed from the same direction as in FIG. 2.

Note that the position of the vicinity of the downstream end in the conveyance direction of the supply conveyance path 9 is the same as the position of, for example, the developer delivery portion for delivering the developer from the supply conveyance path 9 to the stirring conveyance path 10 in the conveyance direction of the supply conveyance path 9.

Figure 8:
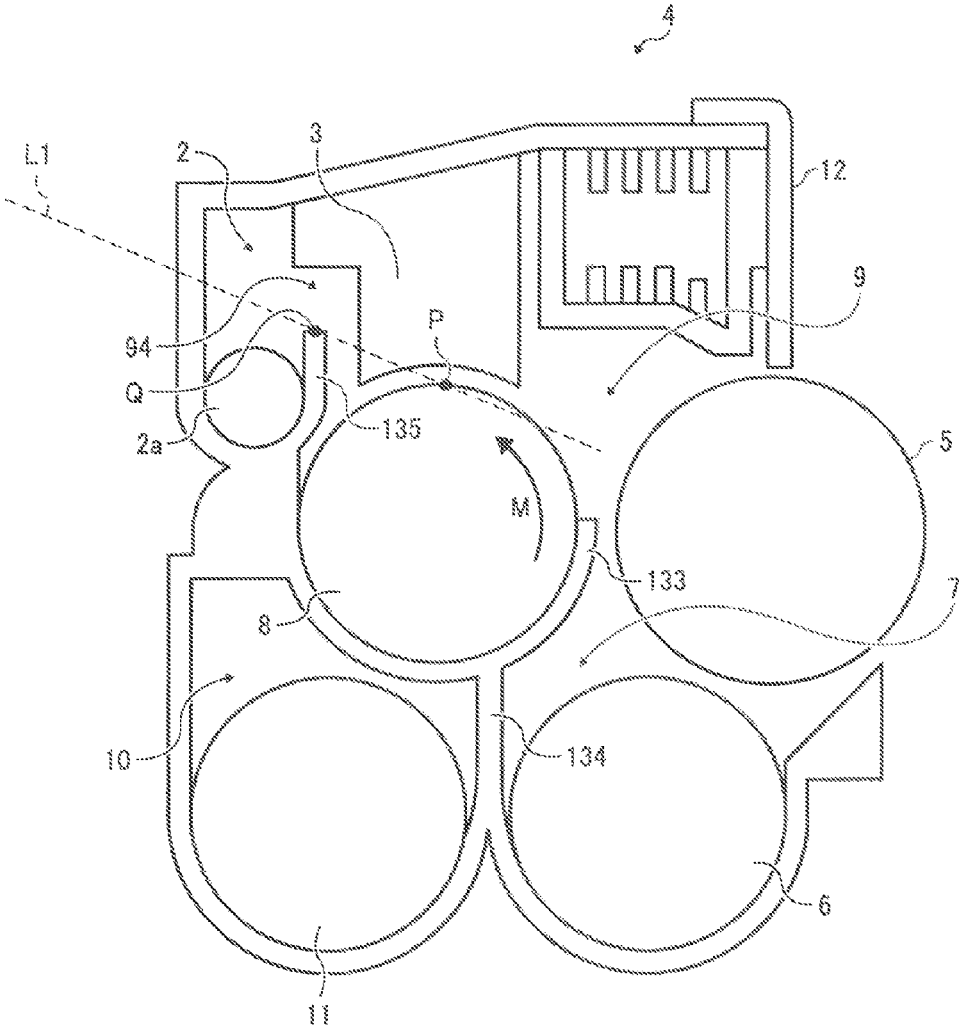
FIG. 8 is a cross-sectional explanatory diagram of the developing device according to Example 1 of the present embodiment.

Moreover, the direction of rotation of the supply screw 8 within the supply conveyance path 9 is a clockwise direction in FIG. 8 (direction of the arrow M), which is a direction in which the developer is lifted up from the lower side and then supplied to the developing roller 5. Here, if the direction of rotation of the supply screw 8 is changed to a counterclockwise direction and the developer is sprinkled onto the developing roller 5, the developer is supplied in a scattered manner to the developing roller 5. However, if the direction of rotation of the supply screw 8 is the clockwise direction as shown in FIG. 8, the developer that is accumulated in the lower part of the supply conveyance path 9 is lifted up from the lower side and supplied to the developing roller 5. The supplying properties of the developer can be stabilized by lifting up the developer from the lower part, instead of supplying the developer in a scattered manner. For this reason, the direction of rotation of the supply screw 8 of the developing device 4 is set to the clockwise direction as shown in FIG. 8.

Particularly when the developer supplied to the developing roller 5 is recovered to the recovery conveyance path 7 without being returned to the supply conveyance path 9 as in the developing device 4 of the present embodiment, the amount of developer decreases as it is sent to the downstream of supply conveyance path 9. Therefore, the developing device in which the developer accumulated in the lower part is scooped up and supplied to the developing roller 5 is excellent in terms of the supplying properties of the developer.

Here, the developer conveyed within the developer conveyance path 9 is scattered by its moving force or by the rotating force of the supply screw 8 serving as the developer conveying screw. Also, as shown in FIG. 22, if the developer discharge port 94 is disposed simply at a predetermined height level of the supply conveyance path 9 serving as the developer conveyance path, the scattered developer might fly in the path indicated by an arrow T in FIG. 22 and be discharged through the developer discharge port 94. When the developer scatters and is discharged, there is a possibility that the scattered developer is discharged even if an appropriate amount or less of developer is conveyed to the position within the supply conveyance path 9 provided with the developer discharge port 94. If the scattered developer is discharged in this manner, there is a possibility that the developer the developer within the developing device 4 is discharged from the developer discharge port despite that the amount of this developer is less than or equal to an appropriate amount. Consequently, the amount of developer within the developing device 4 falls below a necessary amount, whereby the developer cannot be supplied to the photoreceptor 1 stably. Then, if the developer is supplied to the photoreceptor 1 in an unstable manner, image omission and other abnormal images occur.

Note that the path through which the scattered developer moves toward the developer discharge port 94 is shown by the arrow T in FIG. 22. The arrow T schematically shows the path through which the scattered developer moves toward the developer discharge port 94, but the arrow T is not the only component to show the path through which the scattered developer moves through the developer discharge port 94.

EXAMPLE 1

Next is described the first example (called "Example 1" hereinafter) having the characteristics of the developing device 4 of this Embodiment 1.

Figure 9:
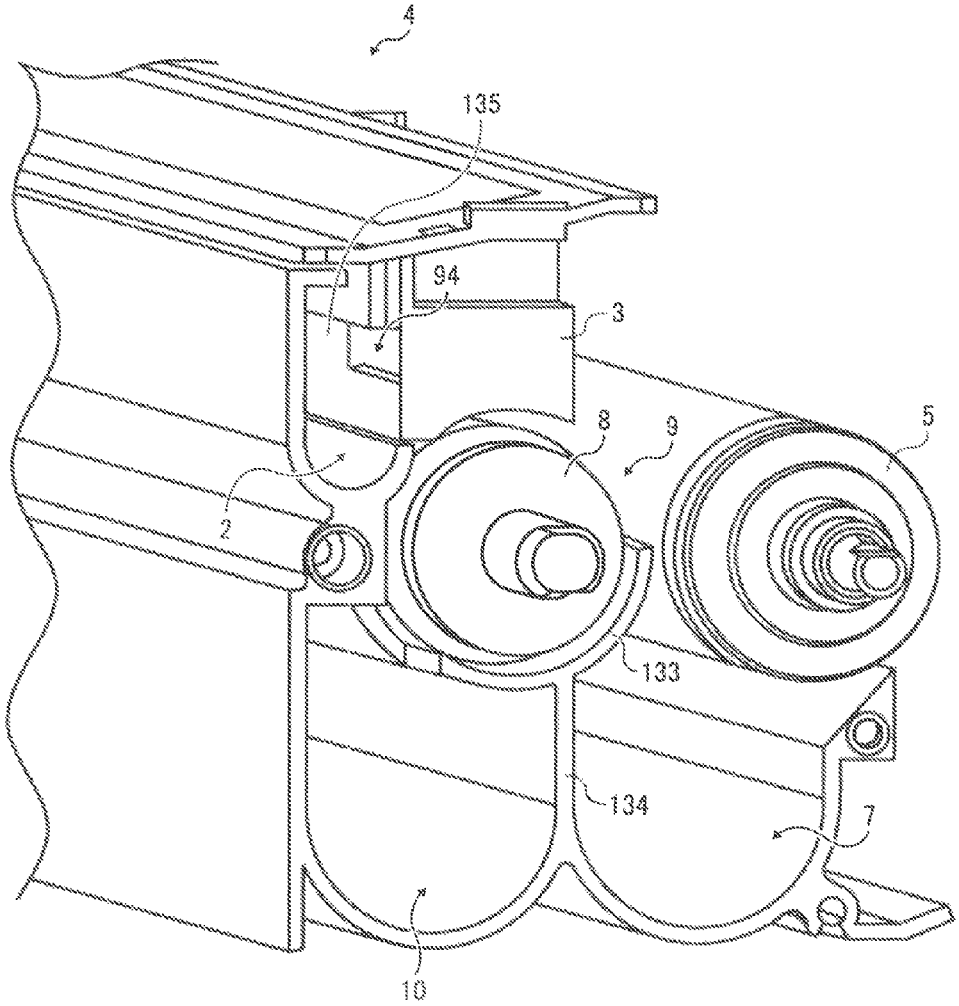
FIG. 9 is a perspective view showing the configuration of the vicinity of a near side end portion of the developing device of Example 1, which is obtained after removing a stirring screw, a recovery screw, and a developing doctor from the developing device.
Figure 10:
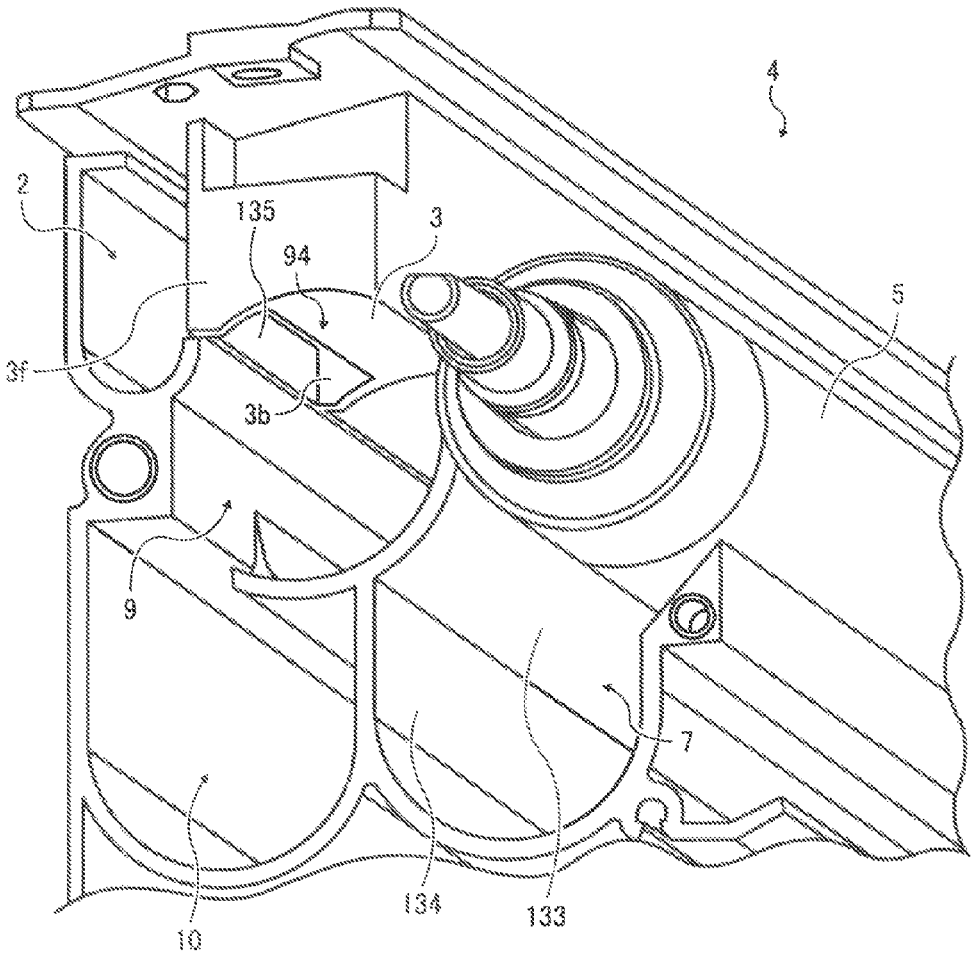
FIG. 10 is a perspective view showing the configuration of the vicinity of the near side of the developing device of Example 1 shown in FIG. 9, which is obtained after removing a supply screw from the developing device.
Figure 11:
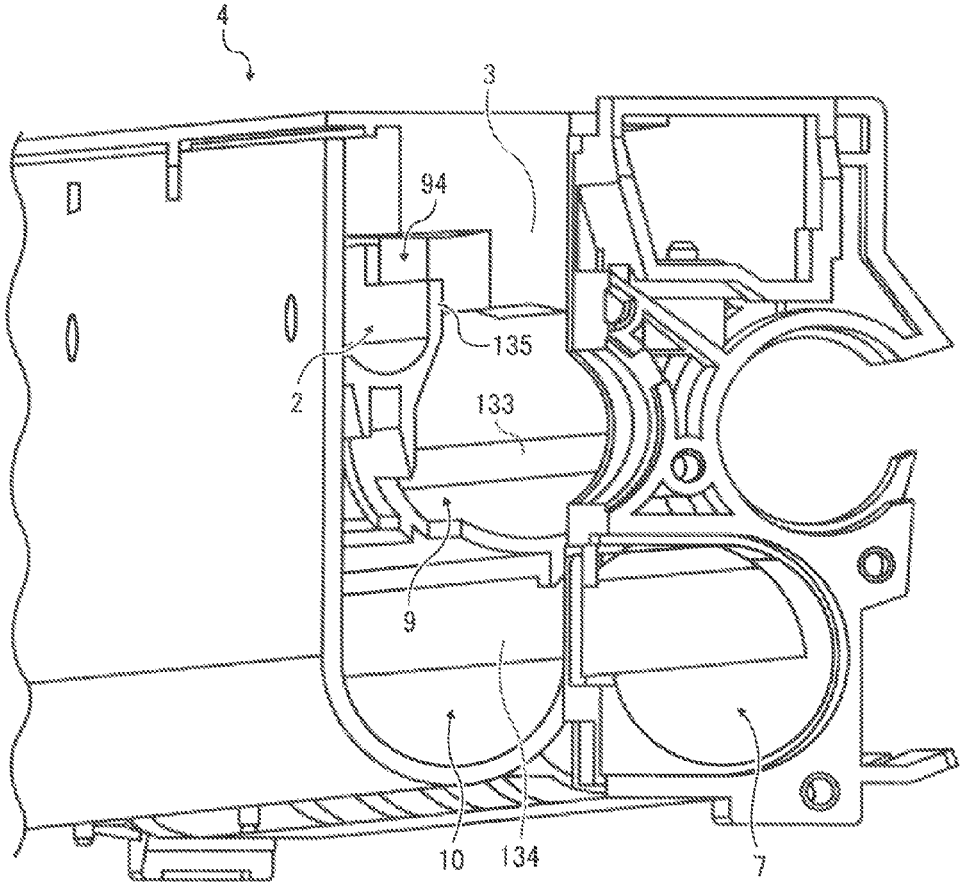
FIG. 11 is a perspective explanatory diagram showing the configuration of the vicinity of a near side of the developing device of Example 1 shown in FIG. 10, which is obtained after removing a developing roller from the developing device.
Figure 12:
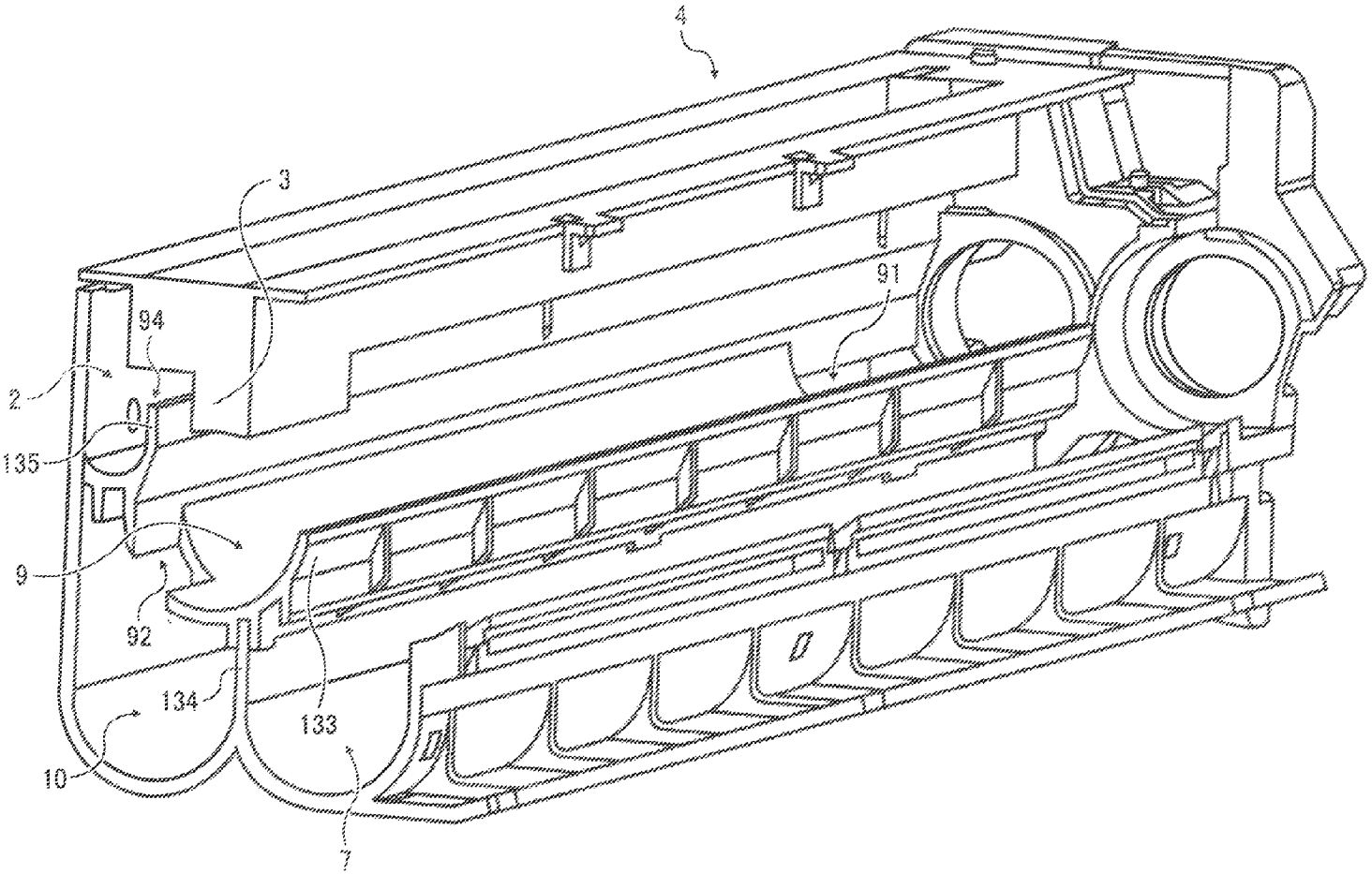
FIG. 12 is a perspective view, in which the developing device of Example 1 shown in FIG. 11 is viewed from a direction different from that of FIG. 11.

FIG. 8 shows the configuration of the developing device 4 of Example 1. FIG. 9 shows the configuration of the vicinity of a near-side end portion of the developing device 4 of Embodiment 1 in which the stirring screw 11, recovery screw 6 and developing doctor 12 are removed therefrom. FIG. 10 is a view showing the vicinity of the near side of the developing device 4 of Example 1 in which the supply screw 8 is further removed from the configuration shown in FIG. 9, the developing device being viewed from a direction different from FIG. 9. FIG. 11 shows the developing device 4 of Example 1 in which the developing roller 5 is further removed from the configuration shown in FIG. 10. FIG. 12 is a view of the developing device 4 of Example 1 in which the developing device 4 having the same configuration as that shown in FIG. 11 is viewed from substantially the same direction as in FIG. 3.

As shown in FIG. 8, the developing device 4 of Example 1 has a block member 3 that serves as a scattered developer discharge prevention member for blocking a path (arrow T in FIG. 22) through which scattered developer moves toward the developer discharge port 94, the scattered developer being obtained by rotating the supply screw 8, which is the developer conveying member, to convey the developer. Because the developing device has the block member 3 for blocking the path through which the developer scattered as a result of a conveyance operation performed by the supply screw 8 moves toward the developer discharge port 94, the scattered developer can be prevented from being discharged, and thereby the developer can be prevented from being discharged despite that the amount of developer within the developing device 4 is not increased. For this reason, a necessary amount of developer can be secured within the developing device 4, and the developer can be supplied to the photoreceptor 1 stably. Accordingly, the electrostatic latent image on the photoreceptor 1 can be formed into a toner image well, the occurrence of image omission and other abnormal images can be prevented, and excellent image formation can be performed.

Moreover, the developing device 4 of Example 1 is provided with the block member 3 for blocking a straight line (L1 in FIG. 8) that connects the lowermost point of the developer discharge port 94 (Q in FIG. 8) and the top of the upper part of the supply screw 8 (P in FIG. 8) to each other. The block member 3 is provided in a section facing the developer discharge port 94. Also, the developer discharged from the developer discharge port 94 reaches the developer discharge port 94 through the space surrounded by the partition wall 135 located on the lower part of the developer discharge port 94, the block member 3, a side wall 3*f* located on the near side of the block member 3, and a side wall 3*b* located on the far side of the block member 3. By providing the block member 3 to cut off the straight line L1, the developer that is scattered from the top P of the upper part of the supply screw 8 in the tangential direction of a circumference drawn by a wing portion can be prevented from passing through the developer discharge port 94. Moreover, as shown in FIG. 8, because the block member 3 is disposed so as to cut off the straight line L1 from the casing of the developing device 4 on the upper part of the supply conveyance path 9, the path (arrow T in FIG. 22) through which the developer scattered above the straight line L1 moves toward the developer discharge port 94 can be prevented from being blocked. Therefore, the scattered developer can be securely prevented from reaching the developer discharge port 94.

Moreover, the block member 3 is a member the bottom surface of which is made of a round-shaped resin that follows the shape of the supply screw 8 in the upper part of the supply conveyance path 9. Because the block member is in a round shape so as to follow the shape of the supply screw 8, the entire bottom surface of the block member 3 can be brought close to the supply screw 8 so as to cover the entire supply screw 8. Therefore, the upper part of the supply screw 8 that causes the developer to scatter is covered, whereby the developer scattered by the supply screw 8 can be prevented from flying to the developer discharge port 94.

Furthermore, as shown in FIG. 12, because the block member 3 protrudes at the periphery of the developer discharge port 94 of the supply conveyance path 9, the section of the supply conveyance path provided with the block member 3 is made narrower than the supply conveyance path 9 on the upstream side in the conveyance direction of the supply screw 8 with respect to the block member 3. Therefore, the amount of developer in relation to the capacity of the supply conveyance path 9 is larger at the position provided with the block member 3 than the upstream side in the conveyance direction with respect to the position provided with the block member 3. Therefore, in the vicinity of the lower end portion in the conveyance direction of the supply conveyance path 9 where the developer is no longer applied with a conveying force, the developer rises between the side wall of the block member 3 and the partition wall 135. Consequently, the supply screw 8 is buried in the developer, and the developer is prevented from being scattered by the rotation of the supply screw 8. Moreover, in the vicinity of the developer discharge port 94, the change in the developer surface that is caused when the supply screw flips when the upper part of the wing portion of the supply screw 8 is exposed from the developer surface can be alleviated. Therefore, sensitive discharge can be expected with respect to the increase and decrease of the amount of developer within the developing device 4.

By providing such block member 3, when the bulk of the developer is increased by supplying the developer, the increment of the developer spills out of the developer discharge port 94.

Note that in the developing device 4, the premixed toner is replenished into the developing device 4 by the toner replenishment control device, not shown, and when the amount of developer within the developing device 4 increases, the bulk of the developer in the vicinity of the downstream end in the conveyance direction of the supply conveyance path 9 increases.

Next is described the fact that the bulk of the developer in the vicinity of the downstream end in the conveyance direction of the supply conveyance path 9 increases as the amount of developer within the developing device 4 increases.

In the developing device 4, the trends of the developer vary according to the change in the amount of developer to be conveyed by the stirring screw 11 when the premixed toner is replenished and according to the amount of developer to be delivered from the stirring conveyance path 10 to the supply conveyance path 9.

For example, in the case in which the amount of developer to be conveyed by the stirring screw 11 after the premixed toner is replenished does not change significantly, the amount of developer to be supplied to the upstream side in the conveyance direction of the supply conveyance path 9 does not change. Moreover, in the case in which the amount of developer to be delivered from the stirring conveyance path 10 to the supply conveyance path 9 is close to the upper limit of the deliverable amount when the developer is not replenished, the amount of developer to be supplied to the upstream side in the conveyance direction of the supply conveyance path 9 does not change significantly.

In the developing device 4 with the above configuration, even if the premixed toner is replenished, the amount of developer to be conveyed through the supply conveyance path 9 does not change, and the amount of developer to be supplied from the supply conveyance path 9 to the developing roller 5 is substantially constant, hence the amount of developer that is sent to the vicinity of the downstream end in the conveyance direction of the supply conveyance path 9 by the supply screw 8 per hour does not change significantly.

On the other hand, in the case in which the amount of developer to be conveyed through the stirring conveyance path 10 does not change significantly, the increased developer is accumulated in the vicinity of the upstream end in the conveyance direction of the stirring conveyance path 10 once the premixed toner is replenished from the toner replenishing port 95. In the case in which the amount of developer to be delivered from the stirring conveyance path 10 to the supply conveyance path 9 does not change, the increment of the developer is accumulated in the stirring conveyance path 10 and in the vicinity of the upstream end in the conveyance direction.

When the developer is accumulated in the vicinity of the upstream end in the conveyance direction, the developer on the stirring conveyance path 10 blocks the excess opening portion 92 at which the developer is delivered from the supply conveyance path 9 to the stirring conveyance path 10. When the excess opening portion 92 is blocked by the developer, the developer cannot move from the supply conveyance path 9 to the stirring conveyance path 10. However, the developer is constantly conveyed by the supply screw 8, the developer is accumulated in the vicinity of the downstream end in the conveyance direction of the supply conveyance path 9, whereby the bulk of the developer increases. Then, when the bulk of the developer accumulated in the vicinity of the downstream end in the conveyance direction of the supply conveyance path 9 increases to the height level of the developer discharge port 94, the developer P is discharged to the discharge conveyance path 2 and then to the outside of the developing device 4 through the discharge conveyance path 2.

In this configuration, when the stirring conveyance path 10 is filled with the developer, the developer spills out of the excess opening portion 92 that supplies and conveys excess developer to the stirring conveyance path 10, the excess developer being conveyed to the lowermost stream in the conveyance direction of the supply conveyance path 9 without being used for development. Accordingly, the movement of the developer from the supply conveyance path 9 to the stirring conveyance path 10 can be regulated, and as a result the developer can be led to the developer discharge port 94 and discharged.

In this manner, the amount of developer to be supplied from the stirring conveyance path 10 to the supply conveyance path 9 does not change significantly even if the amount of developer within the developing device 4 increases, but the developer within the developing device 4 can be replaced by disposing the developer discharge port 94 at the downstream end in the conveyance direction of the supply conveyance path 9.

Furthermore, once the premixed toner is replenished, the amount of developer to be supplied to the conveyance direction upstream side of the supply conveyance path 9 increases, but in some cases there is a limit to the amount of developer to be delivered from the supply conveyance path 9 to the stirring conveyance path 10.

In the developing device 4 having such a configuration, once the premixed toner is replenished, the amount of developer to be conveyed to the stirring conveyance path 10 increases as the amount of developer increases, and the amount of developer to be delivered from the stirring conveyance path 10 to the supply conveyance path 9 also increases. Accordingly, the amount of developer to be supplied to the conveyance direction upstream end portion of the supply conveyance path 9 increases, and the amount of developer to be conveyed within the supply conveyance path 9 also increases. However, because amount of developer to be supplied from the supply conveyance path 9 to the developing roller 5 does not change, the amount of developer that reaches the vicinity of the downstream end in the conveyance direction of the supply conveyance path 9 per hour changes. Also, if the amount of developer that reaches the vicinity of the downstream end in the conveyance direction of the supply conveyance path 9 per hours exceeds the upper limit of the amount of developer to be delivered from the supply conveyance path 9 to the stirring conveyance path 10 per hour, the developer is accumulated in the vicinity of the downstream end in the conveyance direction of the supply conveyance path 9, and thereby the bulk of the developer increases. When the bulk of the developer that accumulates in the vicinity of the downstream end in the conveyance direction of the supply conveyance path 9 increases to the height level of the developer discharge port 94, the developer P is discharged to the discharge conveyance path 2 and then to the outside of the developing device 4 through the discharge conveyance path 2.

In this manner, even if the configuration in which the amount of developer to be supplied from the stirring conveyance path 10 to the supply conveyance path 9 per hour increases when the amount of developer within the developing device 4 increases, the developer within the developing device 4 can be replaced by disposing the developer discharge port 94 at the downstream end in the conveyance direction of the supply conveyance path 9.

As described above, by providing the developer discharge port 94 in the vicinity of the downstream end of the supply conveyance path 9, which is a section where the bulk of the developer fluctuates in accordance with the amount of developer within the developing device 4, the developer within the developing device 4 can be replaced efficiently.

Moreover, once the premixed toner is replenished, that is, once the amount of developer in the whole developer conveyance paths increases, the amount of developer to be supplied to the conveyance direction upstream side of the supply conveyance path 9 increases. Accordingly, the developer discharge port 94 can be provided in any position in the developer conveyance direction within the supply conveyance path 9. The reason is that the amount of developer to be supplied to the conveyance direction upstream side of the supply conveyance path 9 increases because the bulk of the developer increases in any position in the developer conveyance direction within the supply conveyance path 9.

However, when the bulk of the developer to be conveyed in the supply conveyance path 9 is irregularly fluctuates in the configuration in which the developer discharge port 94 is provided in the middle of the developer supply region width $\alpha$ of the supply conveyance path 9, if some developer having high bulk is discharged at the developer discharge port 94, there is a possibility that the section below the position provided with the developer discharge port 94 does not have sufficient developer. If there is a shortage of developer within the developer supply conveyance region width $\alpha$ of the supply conveyance path 9, sufficient developer might not be supplied to the developing roller 5, and thereby sufficient developer might not be supplied from the developing roller 5 to the photoreceptor 1, causing image omission and other abnormal images. In response to this problem, the downstream end of the developer discharge port 94 is placed outside the developer supply conveyance region width $\alpha$ by providing the developer discharge port 94 in the vicinity of the downstream end of the supply conveyance path 9, and thus a partial shortage of developer can be prevented.

By providing the block member 3 as shown in FIG. 8, the developer can be prevented from scattering and moving toward the developer discharge port 94. However, when the amount of developer within the developing device 4 increases and thereby bulk of the developer increases to the position where the developer discharge port 94 is provided, there is a possibility that the developer is blocked by the lower surface of the block member 3. If the developer is blocked by the lower surface of the block member 3 when the bulk of the developer is increasing, the stress on the developer increases, deteriorating the developer.

However, by using a sponge or other elastic material as the material of the block member 3, the bulk of the developer increases to reach the lower surface of the block member 3, and the block member 3 is deformed when the bulk of the developer further increases. Such deformation can prevent the increase of the stress on the developer that is caused when the developer is blocked by the lower surface of the block member 3.

EXAMPLE 2

Next is described the second example (called "Example 2" hereinafter) having the characteristics of the developing device 4 of this Embodiment 1.

Figure 13:
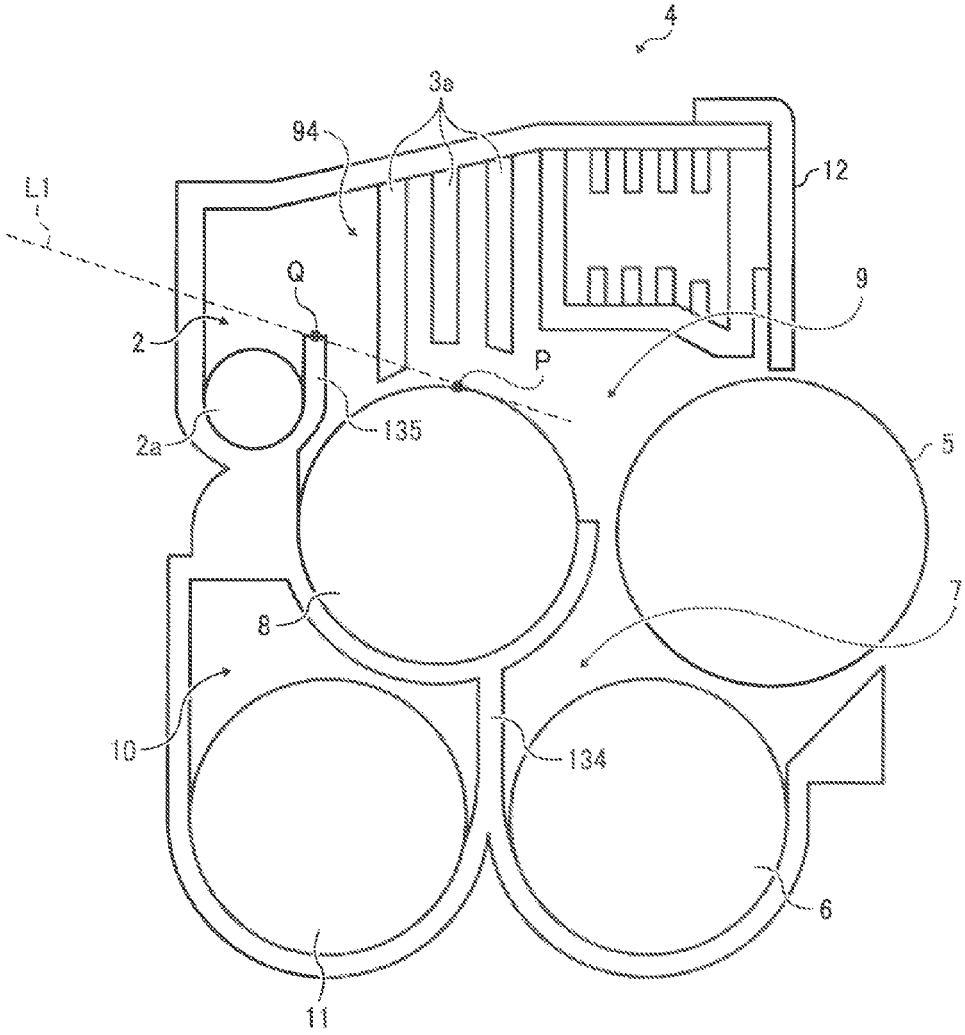
FIG. 13 is a cross-sectional view showing the configuration of the developing device according to Example 2 of the present embodiment.

FIG. 13 shows the configuration of the developing device 4 of this Example 2.

Because the only difference between the configuration of Example 2 and the configuration of Example 1 is the shape of the scattered developer discharge prevention member and the rest of the configurations are identical, only the difference will be described.

As shown in FIG. 13, in the developing device 4 of Example 2 a plurality of plate-like members 3*a* are disposed at intervals to obtain the scattered developer discharge prevention member. Even with such a configuration having the plate-like members 3*a*, as with the block ember 3 of Example 1, it is possible to block the path through which the developer scattered as a result of the conveyance operation of the supply screw 8 moves toward the developer discharge port 94. Therefore, the scattered developer can be prevented from being discharged, and also the developer can be prevented from being discharged despite that the amount of developer within the developing device 4 is not increased. For this reason, a necessary amount of developer can be secured within the developing device 4, and the developer can be supplied to the photoreceptor 1 stably. Accordingly, the electrostatic latent image on the photoreceptor 1 can be formed into a toner image well, the occurrence of image omission and other abnormal images can be prevented, and excellent image formation can be performed.

Also, when the amount of developer within the developing device 4 increases and thereby the bulk of the developer increases, the increment of the developer enters a space between the plate-like members 3*a*. Accordingly, the effect of scattering of the developer can be securely eliminated without applying pressure to the developer, and only the increment of the developer can be led to the developer discharge port 94. Each plate-like member 3*a* can be formed using a highly rigid resin material that does not deform easily, but an elastic material may be used. For example, PET mylar having a thickness of 0.1 through 0.2 [mm] may be provided as the plate-like member 3*a*. According to such a configuration, when the developer scatters, the mylar serves as a wall so that the developer does not directly enter the developer discharge port 94, and when the bulk of the developer increases, the mylar deforms and leads the developer to the developer discharge port 94.

The scattered developer discharge prevention members of Example 1 and Example 2 described above are disposed such as to cut off the straight line L1 from the upper casing of the developing device 4 above the supply conveyance path 9, but the arrangement of the scattered developer discharge prevention members are is not limited to this.

Figure 14:
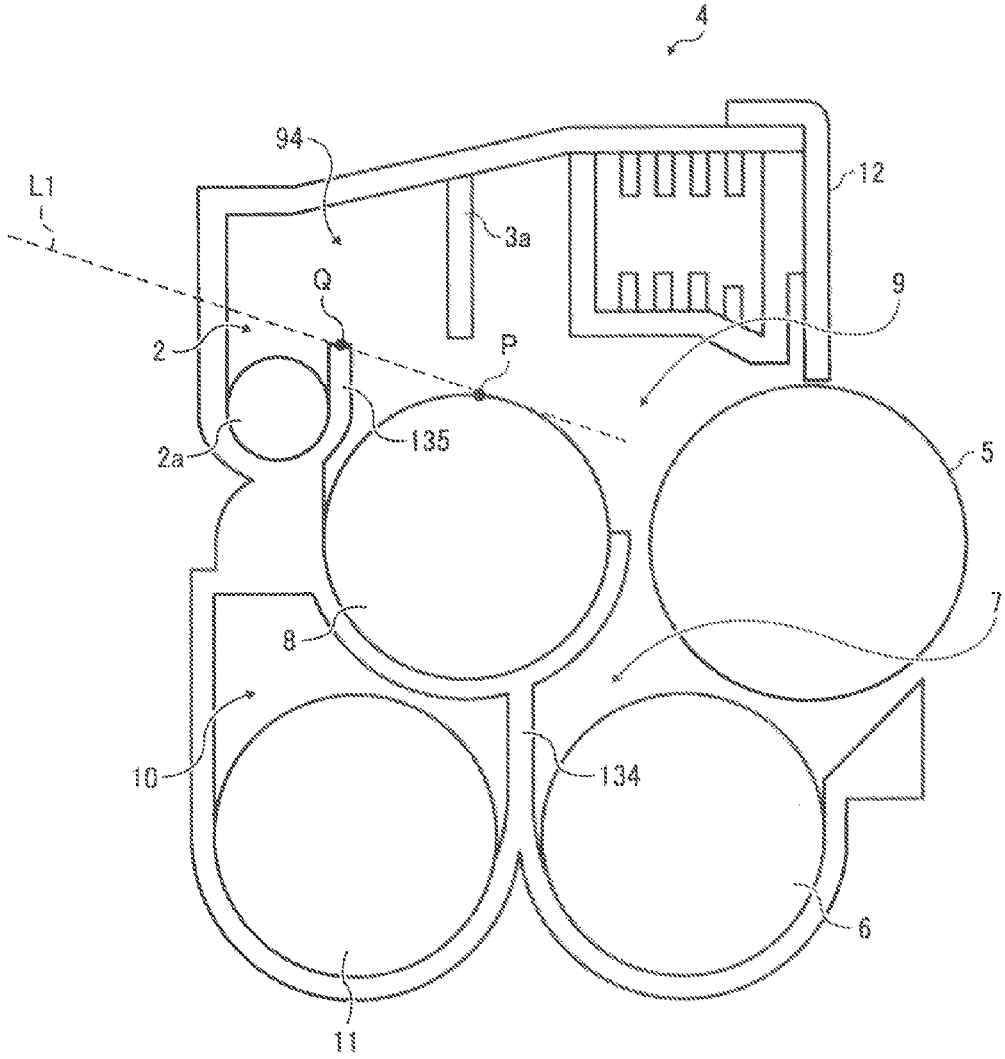
FIG. 14 is a cross-sectional view showing the configuration of the developing device in which the length of a plate-like member is shorter than that of Example 2.

For example, as shown in FIG. 14, a configuration is possible in which the plate-like members 3*a* that are not long enough to reach the straight line L1 are disposed inside the upper casing. By using a member that blocks the space serving as the path through which the scattered developer moves toward the developer discharge port 94, the scattered developer can be prevented from flying and reaching the developer discharge port 94, unlike the developing device 4 without conventional scattered developer discharge prevention members, as shown in FIG. 22. Consequently, the shortage of the developer inside the developing device 4 can be prevented, and thereby the developer can be supplied to the photoreceptor 1 stably. Note that the scattered developer discharge prevention members that are not long enough to reach the straight line L1 are not limited to the plate-like members 3*a* shown in FIG. 14. For example, the short block members 3 shown in FIG. 8 may be used.

Figure 15:
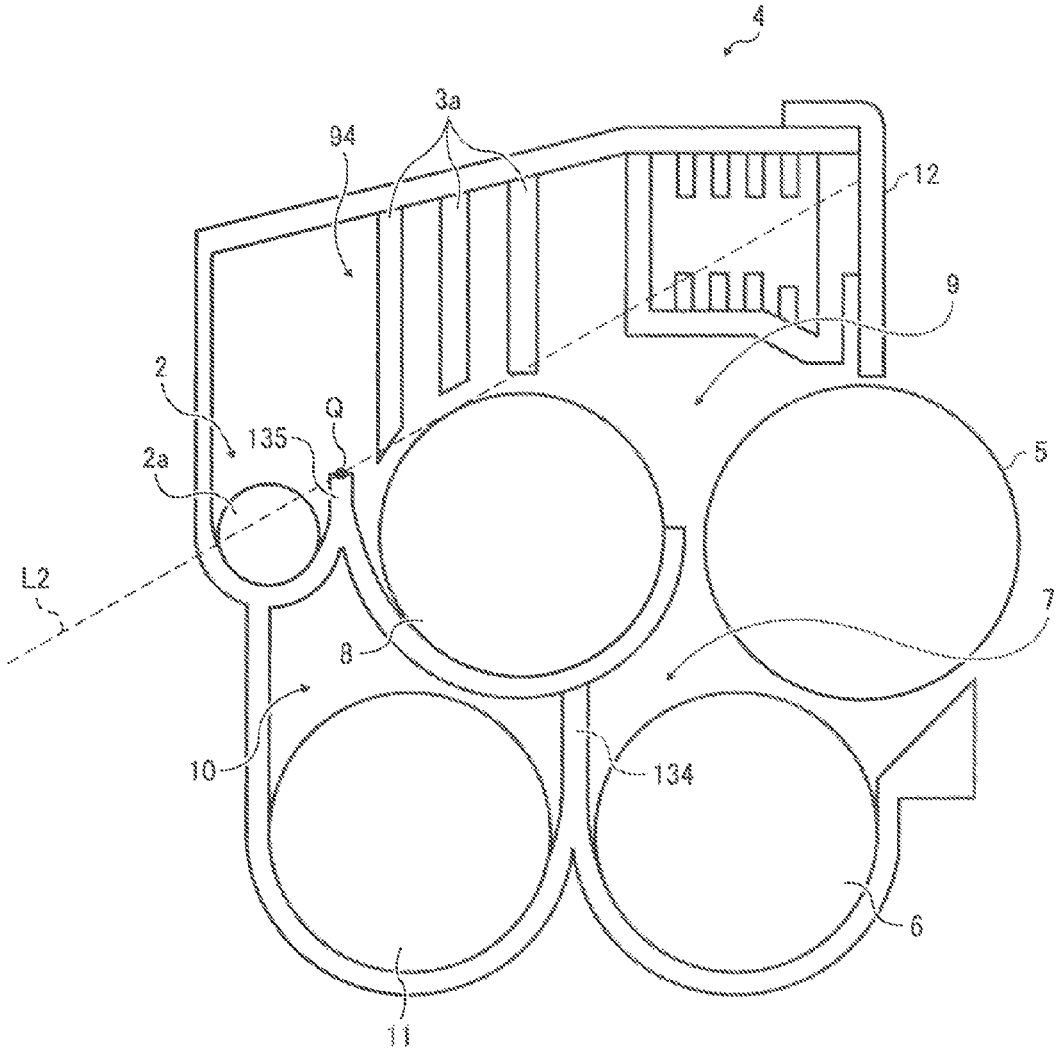
FIG. 15 is a cross-sectional view showing the configuration of the developing device in which the position of a developer discharge port is lower than that of Example 2.

In the configuration of the developing devices 4 shown in FIG. 8, FIG. 13 and FIG. 14, the lowermost point Q of the developer discharge port 94 is positioned higher than the top P of the upper part of the supply screw 8. Regarding the position of the developer discharge port 94, the lowermost point Q of the developer discharge port 94 is sometimes positioned lower than the top P of the upper part of the supply screw 8, as in the developing device 4 shown in FIG. 15. In the case of the developing device 4 shown in FIG. 15, the scattered developer discharge prevention members (the plate-like members 3*a* in FIG. 15) are disposed such as to prevent the tangential that is drawn from the lowermost point Q of the developer discharge port 94 to a circumference drawn by an end portion in the cross-sectional direction of the wing portion of the supply screw 8. By disposing the scattered developer discharge prevention members in this manner, the scattered developer is prevented from flying and passing through the developer discharge port 94, as with Example 1 or Example 2.

EXAMPLE 3

The scattered developer discharge prevention members of Example 1 and Example 2 described above are to mainly prevent the developer scattered in the rotational direction of the supply screw 8 from being discharged from the developer discharge port 94.

In the supply conveyance path 9, the developer scatters not only in the rotational direction of the supply screw 8 but also in the axial direction of the supply screw 8. Next is described the third example (called "Example 3" hereinafter) having the characteristics of the developing device 4 of Embodiment 1, wherein the developer scattered in the axial direction of the supply screw 8 is prevented from being discharged.

Figure 16:
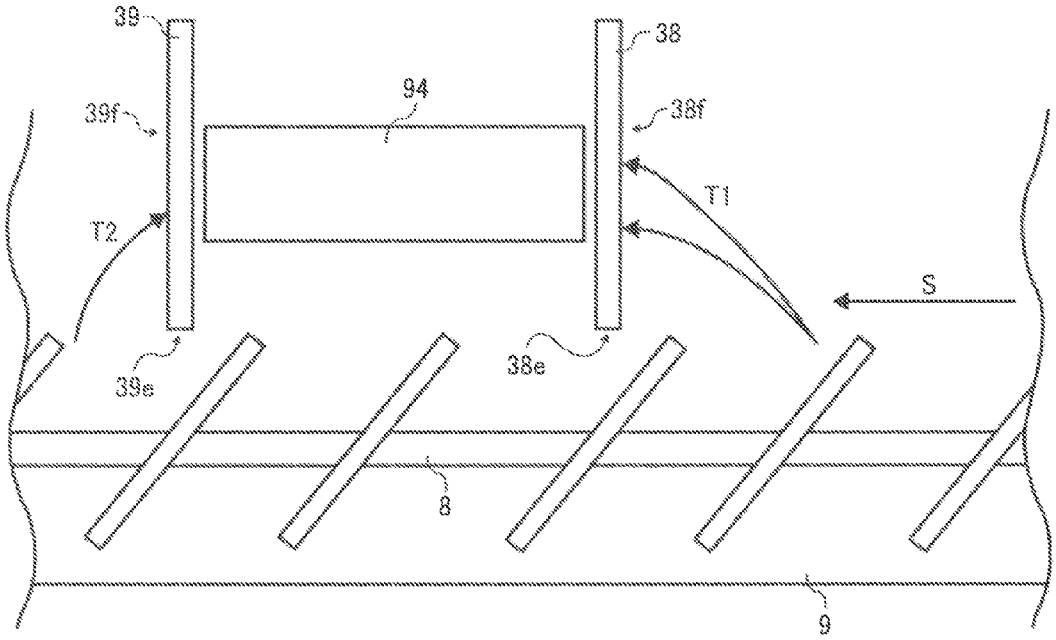
FIG. 16 is a view showing the configuration of the vicinity of a downstream end of a supply conveyance path of the developing device according to Example 3 of the present embodiment.

FIG. 16 shows the configuration of the vicinity of the downstream end of the supply conveyance path 9 in the developing device 4 of Example 3.

Because the only difference between the configuration of Example 3 and the configuration of Example 1 is the shape of the scattered developer discharge prevention member and the rest of the configurations are identical, only the difference will be described.

As shown in FIG. 16, in the developing device 4 of Example 3, the upstream side in the conveyance direction of the supply screw 8 with respect to the developer discharge port 94 is provided with, as the scattered developer discharge prevention member, an upstream side wall member 38 that has a wall surface 38*f* which is perpendicular to the conveyance direction of the supply screw 8 serving as the developer conveying member (arrow S in FIG. 16), and a normal line direction of which runs in opposite direction to the direction of the arrow S.

By providing the upstream side wall member 38, developer T1 that flies in the conveyance direction of the supply screw 8 from the upstream side in the developer conveyance direction with respect to the developer discharge port 94 abuts on the wall surface 38*f* of the upstream side wall member 38. Accordingly, it becomes possible to block the path through which the developer T1 flying in the conveyance direction of the axial direction of the supply screw 8 moves toward the developer discharge port 94. Therefore, the developer T1 that flies in the conveyance direction can be prevented from being discharged directly from the developer discharge port 94.

Moreover, as shown in FIG. 16, in the developing device 4 of Example 3, the downstream side in the conveyance direction of the supply screw 8 with respect to the developer discharge port 94 is provided with, as the scattered developer discharge prevention member, a downstream side wall member 39 that has a wall surface 39*f* which is perpendicular to the conveyance direction of the supply screw 8 (arrow S in FIG. 16), and a normal line direction of which runs in the same direction as the arrow S.

By providing the downstream side wall member 39, developer T2 that flies in the opposite direction to the conveyance direction of the supply screw 8 from the downstream side in the developer conveyance direction with respect to the developer discharge port 94 abuts on the wall surface 39*f* of the downstream side wall member 39. Accordingly, it becomes possible to block the path through which the developer T2 flying in the opposite direction to the conveyance direction of the axial direction of the supply screw 8 moves toward the developer discharge port 94. Therefore, the developer T2 that flies in the opposite direction to the conveyance direction can be prevented from being discharged directly from the developer discharge port 94.

Moreover, an upstream side wall lower end portion 38*e* and a downstream side wall lower end portion 39*e* that are the lower ends of the wall members of the upstream side wall member 38 and the downstream side wall member 39 respectively are positioned below the lower end of the developer discharge port 94, as shown in FIG. 16. By disposing them in this manner, the developers (T1, T2) flying in the axial direction of the supply screw 8 can be securely prevented from being discharged directly from the developer discharge port 94.

The shape of the upstream side wall lower end portion 38*e* and the shape of the downstream side wall lower end portion 39*e* located at the lower ends of the upstream side wall member 38 and the downstream side wall member 39 respectively are identical to the shape of the bottom surface of the block member 3 Example 1, i.e., the round shape so as to follow the shape of the supply screw 8. Because the upstream side wall lower end portion 38*e* and the downstream side wall lower end portion 39*e* are in a round shape so as to follow the shape of the supply screw 8, the upstream side wall lower end portion 38*e* and the downstream side wall lower end portion 39*e* can be brought close to the supply screw 8. By bringing the upstream side wall lower end portion 38*e* and the downstream side wall lower end portion 39*e* close to the supply screw 8, the developers (T1, T2) flying in the axial direction of the supply screw 8 can be securely prevented from being discharged directly from the developer discharge port 94.

It should be noted that in the case in which the developer discharge port 94 is disposed at the lower end in the developer conveyance direction of the supply conveyance path 9, the developer flying in the axial direction of the supply screw 8 can be sufficiently prevented from being discharged directly from the developer discharge port 94, even if there exists only the upstream side wall member 38 as the wall member.

Moreover, in the developing device 4 of Embodiment 1, the downstream side of the developer discharge port 94 of the supply conveyance path 9 is provided with a downstream end wall surface which is perpendicular to the conveyance direction of the supply screw 8 and a normal line direction of which runs in the opposite direction to the conveyance direction of the supply screw 8, and which prevents the movement of the developer in the conveyance direction.

Figure 17:
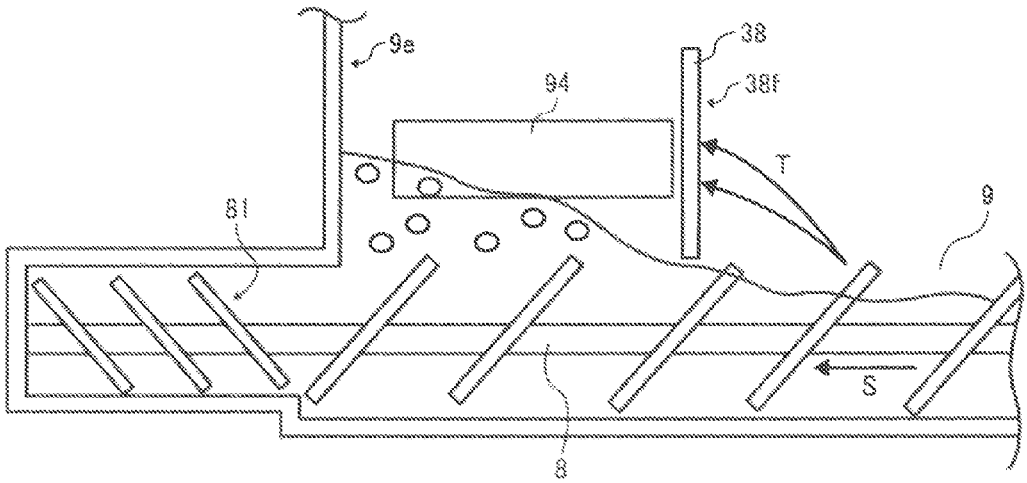
FIG. 17 is a view showing a wall surface located at the downstream end.

FIG. 17 shows a downstream end wall surface 9*e*.

As shown in FIG. 17, the downstream end wall surface 9*e* is provided on the downstream side of the developer discharge port 94 in the supply conveyance path 9. The developer discharge port 94 is provided such that the foot of the developer that is prevented from being conveyed and thereby is accumulated and increased by the downstream side wall surface 9*e* is caught in the developer discharge port 94. By disposing the developer discharge port 94 so that the foot of the developer is caught therein, the foot of the developer is discharged through the developer discharge port 94 when the developer is accumulated and raised on the upstream side of the downstream end wall surface 9*e* and thereby the bulk of the developer increases. Therefore, the developer discharge port 94 can be prevented from being clogged up by the developer.

Note that in Example 1 and Example 2, an end surface at the downstream end in the conveyance direction of the supply screw 8 in the casing forming the supply conveyance path 9 functions as the downstream end wall surface 9*e*. Also, in Example 3 the back of the wall surface 39*f* of the downstream side wall member 39 functions as the downstream end wall surface 9*e*.

The developing device 4 of this Embodiment 1 has the developer discharge port 94 in the supply conveyance path 9, which is the developer supply conveyance path to which the developer is conveyed by the supply screw 8 serving as the developer conveying screw for conveying the developer in the developer supply region of the developer conveyance path. Also, the developing roller 5 serving as the developer carrier is disposed on the side where the wing portion of the supply screw 8 moves from the lower side to the upper side as it rotates (right side in FIG. 8). Moreover, the developer discharge port 94 is disposed on the side where the wing portion of the supply screw 8 moves from the upper side to the lower side as it rotates (left side in FIG. 8). By disposing the developing roller 5 on the side where the wing portion of the supply screw 8 moves from the lower side to the upper side, the developer within the supply conveyance path 9 can be scooped up by the supply roller 5 and then supplied stably to the developing roller 5. In addition, by disposing the developer discharge port 94 on the opposite side of the developing roller 5 across the supply screw 8, the developer discharge port 94 can be provided within the developer supply conveyance region α with respect to the axial direction of the supply screw 8, the developer supply conveyance region being a region for supplying the developer to the developing roller 5. Accordingly, the size of the developing device 4 can be reduced.

Embodiment 2

In Embodiment 1 described above, there was described the developing device 4 that is provided with the scattered developer discharge prevention members for preventing the scattered developer from flying and reaching the developer discharge port 94, the scattered developer being obtained by conveying the developer using the supply screw 8 serving as the developer conveying member. The configuration of preventing the developer from scattering and being discharged from the developer discharge port 94 even if the amount of developer within the developing device 4 is not increased may be configured so as to prevent the developer from scattering.

Next is described the configuration of Embodiment 2 in which the developer is prevented from scattering and thereby is prevented from being discharged even if the amount of developer within the developing device is not increased.

EXAMPLE 4

Next is described the first example (called "Example 4" hereinafter) having the characteristics of the developing device 4 of Embodiment 2.

It should be noted that the configuration of Example 4 is different from the configuration of Example 1 in that no scattered developer discharge prevention member is provided and the shape of the supply screw 8 is different, but the rest of the configurations are identical, and thus only the differences will be described.

Figure 18:
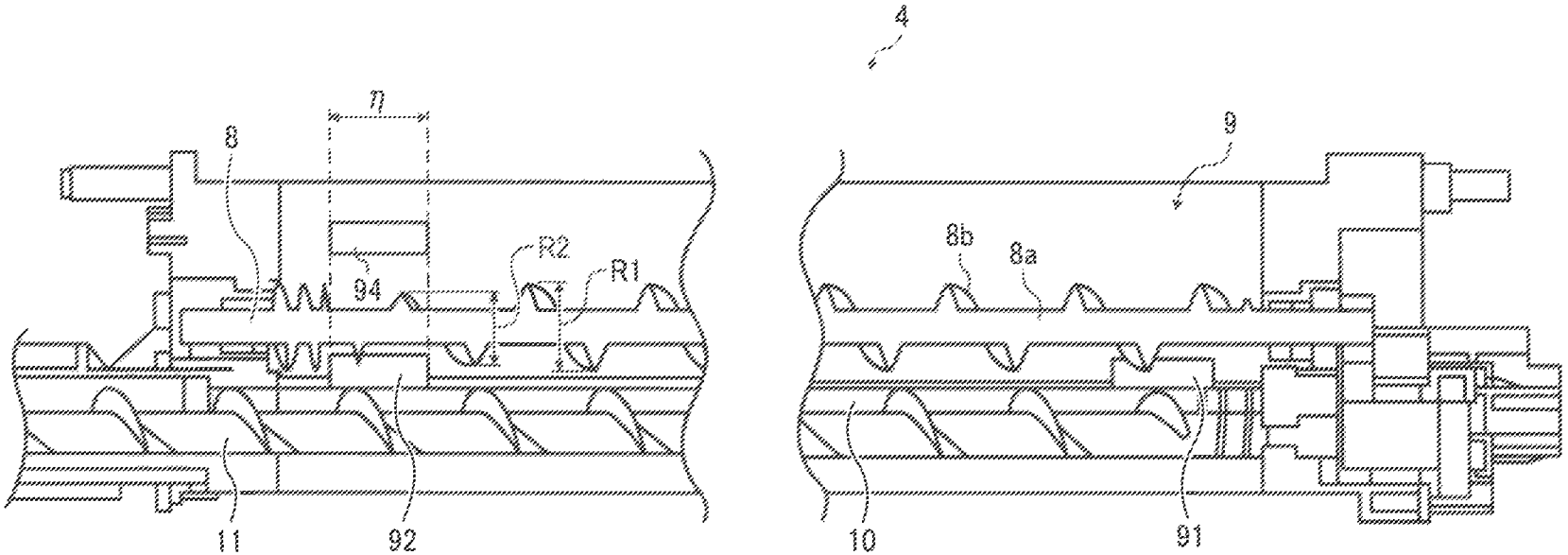
FIG. 18 is a side cross-sectional view showing the developing device according to Example 4 of the present embodiment.

FIG. 18 shows a side cross section of the developing device 4 of Example 4.

As shown in FIG. 18, the developing device 4 of Example 4 has a rotation axis 8*a*, wing portions 8*b* that are provided in a spiral form on the rotation axis 8*a*, and the supply screw 8 serving as the developer conveying screw for conveying the developer in the axial direction by rotating itself. An external diameter R2 of the wing portion 8*b* within a developer discharge region η provided with the developer discharge port 94 with respect to the developer conveyance direction of the supply conveyance path 9 is smaller than an external diameter R1 of the wing portion 8*b* located on the upstream side in the developer conveyance direction of the developer discharge region η.

In the developing device 4 of Example 4, the external diameter R1 of the wing portion 8*b* on the upstream side in the developer conveyance direction of the developer discharge region η is ϕ22 [mm], and the external diameter R2 of the wing portion 8*b* within the developer discharge region η is ϕ18 [mm].

In Example 4, because the external diameter R2 of the wing portion 8*b* within the developer discharge region η is smaller than the external diameter R1 of the wing portion 8*b* positioned on the upstream side in the developer conventional direction in the developer discharge region η, the speed of conveyance of the developer within the developer discharge region η can be made slower than the speed of conveyance of the developer within other part. If the speed of conveyance is low, the moving force of the developer becomes weak, so that the developer does not scatter easily. Moreover, by making the external diameter small, the force of the developer moving in the direction of the external diameter of the wing portions 8*b* becomes weak, so that the developer does not scatter easily. In this manner, the rotation of the supply screw 8 can prevent the developer from scattering in the developer discharge region η. Accordingly, the scattered developer cannot easily reach the developer discharge port 94 and is prevented from being discharged. Furthermore, the developer is prevented from being discharged even if the amount of developer within the developing device 4 is not increased. Therefore, a necessary amount of developer can be secured within the developing device 4, and the developer can be supplied to the latent image carrier stably.

EXAMPLE 5

Next is described the second example (called "Example 5" hereinafter) having the characteristics of the developing device 4 of Embodiment 2.

Example 5 is different from Example 4 in terms of the shape of the supply screw 8 in the developer discharge region η, but the rest of the configurations are identical, and thus only the difference will be described.

Figure 19:
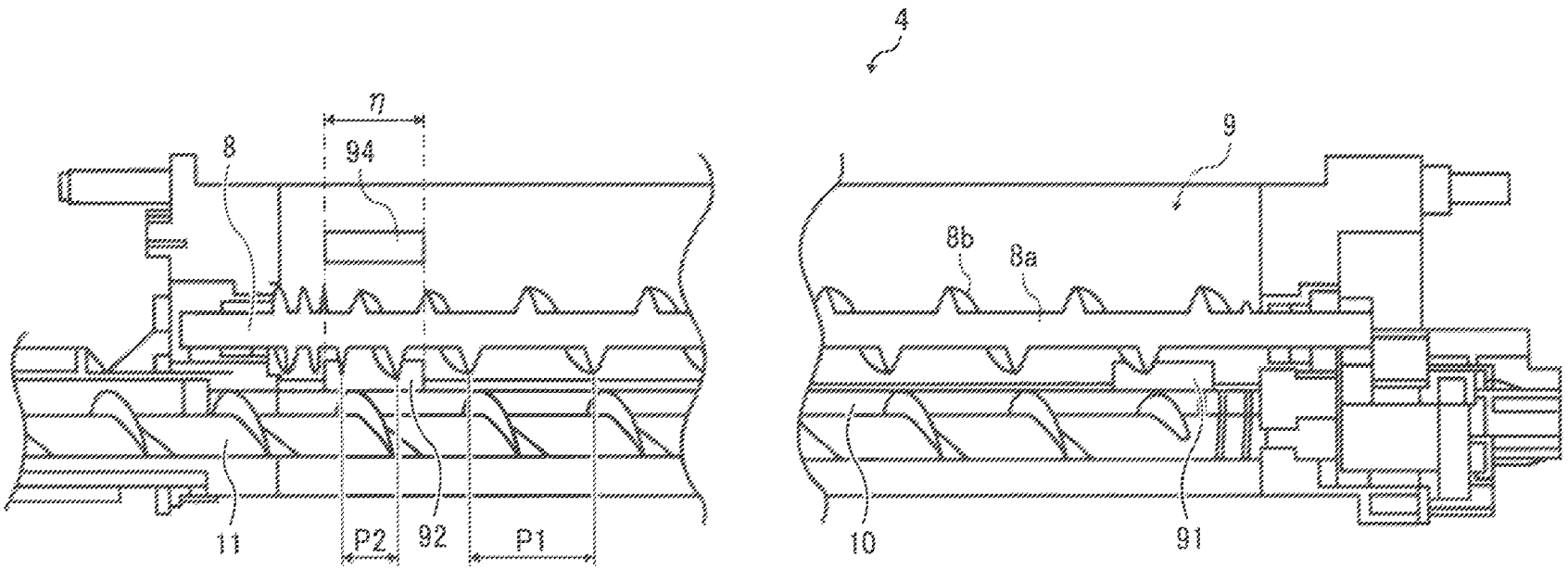
FIG. 19 is a side cross-sectional view showing the developing device according to Example 5 of the present embodiment.

FIG. 19 shows the configuration of the developing device 4 of Example 5.

As shown in FIG. 19, the developing device 4 of Example 5 has the rotation axis 8*a*, the wing portions 8*b* that are provided in a spiral form on the rotation axis 8*a*, and the supply screw 8 serving as the developer conveying screw for conveying the developer in the axial direction by rotating itself. A pitch width P2 of the wing portion 8*b* within a developer discharge region η provided with the developer discharge port 94 with respect to the developer conveyance direction of the supply conveyance path 9 is narrower than a pitch width P1 of the wing portion 8*b* located on the upstream side in the developer conveyance direction of the developer discharge region η.

In Example 5, because the pitch width P2 of the wing portion 8*b* within the developer discharge region η is narrower than the pitch width P1 of the wing portion 8*b* positioned on the upstream side in the developer conventional direction in the developer discharge region η, the speed of conveyance of the developer within the developer discharge region η can be made slower than the speed of conveyance of the developer within other part. If the speed of conveyance is low, the moving force of the developer becomes weak, so that the developer does not scatter easily. In this manner, the rotation of the supply screw 8 can prevent the developer from scattering in the developer discharge region η. Accordingly, the scattered developer cannot easily reach the developer discharge port 94 and is prevented from being discharged. Furthermore, the developer is prevented from being discharged even if the amount of developer within the developing device 4 is not increased. Therefore, a necessary amount of developer can be secured within the developing device 4, and the developer can be supplied to the latent image carrier stably.

EXAMPLE 6

Next is described the third example (called "Example 6" hereinafter) having the characteristics of the developing device 4 of Embodiment 2.

Example 6 is different from Example 4 in terms of the shape of the supply screw 8 in the developer discharge region η, but the rest of the configurations are identical, and thus only the difference will be described.

Figure 20:
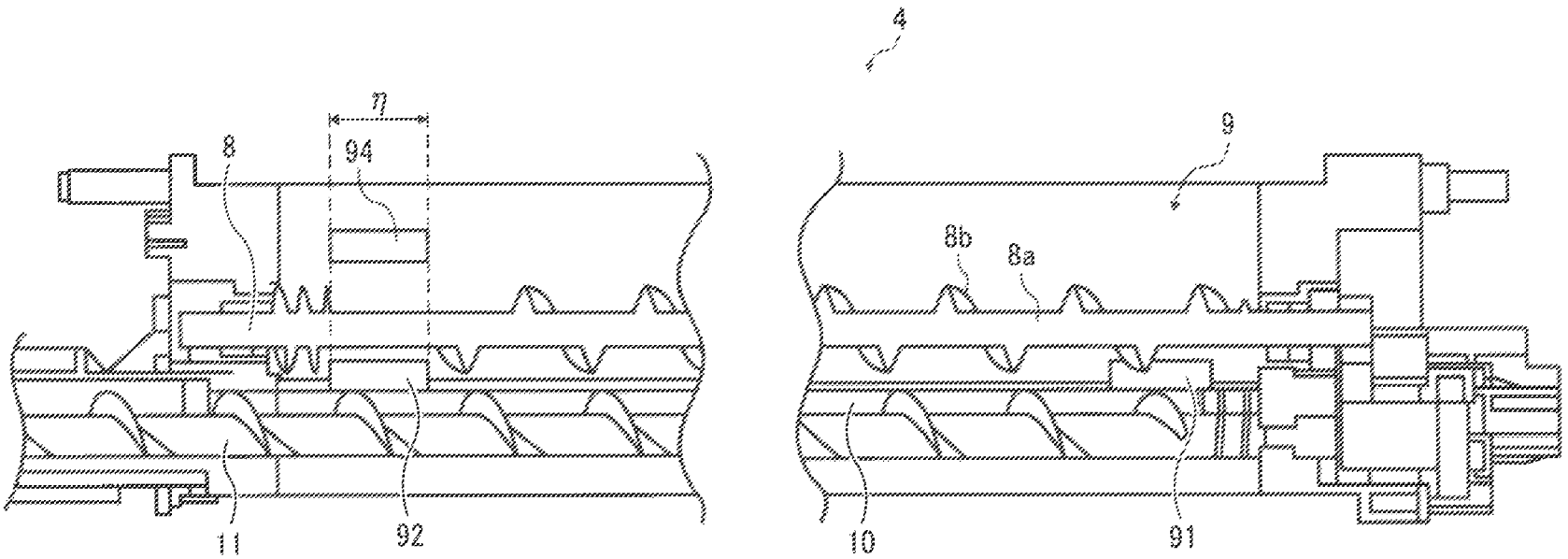
FIG. 20 is a side cross-sectional view showing the developing device according to Example 6 of the present embodiment.

FIG. 20 shows a side cross section of the developing device 4 of Example 6.

As shown in FIG. 20, the developing device 4 of Example 6 has the rotation axis 8*a*, the wing portions 8*b* that are provided in a spiral form on the rotation axis 8*a*, and the supply screw 8 serving as the developer conveying screw for conveying the developer in the axial direction by rotating itself. The supply screw 8 within the developer discharge region η provided with the developer discharge port 94 with respect to the developer conveyance direction of the supply conveyance path 9 does not have the wing portions 8*b* but the rotation axis 8*a*.

In Example 6, without the wing portions 8*b* within the developer discharge region η, the rotation of the supply screw 8 can prevent the developer from scattering in the developer discharge region η. Accordingly, the scattered developer cannot easily reach the developer discharge port 94 and is prevented from being discharged therefrom. Furthermore, the developer is prevented from being discharged even if the amount of developer within the developing device 4 is not increased. Therefore, a necessary amount of developer can be secured within the developing device 4, and the developer can be supplied to the latent image carrier stably.

The developing device with the configuration described in Embodiment 1 and the developing device with the configuration described in Embodiment 2 may be combined.

For example, the developing device 4 with the block member 3 shown in FIG. 8 can use the supply screw 8 that does not have the wing portions 8*b* within the developer discharge region η, such as the supply screw 8 shown in FIG. 19. According to such a configuration, the scattered developer can be securely prevented from being discharged, and the developer can be discharge at amount according to the increase of the bulk of the developer.

In the developing device 4 that circulates the developer unidirectionally and has the supply conveyance path 9, stirring conveyance path 10 and recovery conveyance path 7, the developer that reaches the downstream end in the conveyance direction of the supply conveyance path 9 is excess developer that does not contribute to development. In the developing device 4 circulating the developer unidirectionally, it is suitable that the developer increased by replenishment of the premixed toner is discharged at the position where the excess developer accumulates. The reasons will be described hereinafter.

Because the recovery conveyance path 7 conveys the developer carried by the developer roller 5 and caused to pass through the developing region, the amount of developer conveyed within the recovery conveyance path 7 hardly changes even if the amount of developer within the developing device 4 changes. Therefore, the developer cannot be discharged due to the increase in the bulk of the developer.

In the stirring conveyance path 10, the amount of developer to be conveyed increases and thereby the bulk of the developer increases as the amount of the developer within the developing device 4 increases. However, even if the developer does not increase, the developer is discharged due to irregularities in the scattering of the developer and in the amount of developer to be conveyed, and thus there is a possibility that a necessary amount of developer cannot be delivered to the supply conveyance path 9. For this reason, it is not appropriate to discharge the developer when the bulk of the developer increases within the stirring conveyance path 10. Moreover, the configuration of discharging the developer in the middle of the supply conveyance path 9 is not appropriate because there is a possibility that the bulk of the developer increases even if the amount of developer within the developing device 4 does not increase, and thereby a shortage of the developer occurs on the downstream side in the conveyance direction rather than the position where the developer is discharged.

For these reasons, in the developing device 4 that circulates the developer unidirectionally, it is suitable that an increment of the developer obtained by replenishing the premixed toner is discharged at the position where the developer accumulates to reach the downstream end in the conveyance direction of the supply conveyance path 9.

In the developing device 4 of this embodiment, although the excess opening portion 92 has a larger opening than the developer discharge port 94, the developer discharge port 94 may have a larger opening than the excess opening portion 92.

With reference to the configuration applied to the developing device 4 shown in FIG. 4, the above embodiments have described the configuration in which when the bulk of the developer existing in the vicinity of the downstream end in the conveyance direction of the supply conveyance path 9 exceeds a predetermined height level, the developer discharge means discharges some of this developer. The configuration to which the characteristics of the present invention can be applied is not limited to the one shown in FIG. 4, and thus the characteristics of the present invention can be applied similarly to the developing device 4 having the configuration shown in FIG. 6 and FIG. 21.

Moreover, the above embodiments have described the developing device that uses, as a developer, a two-component developer consisting of a carrier and a toner. The developing device to which the characteristics of the present invention are applied is not limited to the developing device that uses the two-component development. A developing device that uses one-component developer can also be applied as long as it has a configuration in which the developer is replenished by the developer replenishing means and an increment of the developer within the developing device is discharged by the developer discharge means.

As described above, according to Embodiment 1, Example 1 has the block member 3 as the scattered developer discharge prevention member for blocking the path in which the developer scattered as a result of the conveyance operation of the supply screw 8 serving as the developer conveying member moves toward the developer discharge port 94. Accordingly, the scattered developer can be prevented from reaching the developer discharge port 94 and being discharged therefrom, and the developer can be prevented from being discharged despite that the amount of developer within the developing device 4 is not increased. Therefore, a necessary amount of developer can be secured within the developing device 4, and the developer can be supplied stably to the latent image carrier.

Also, the block member 3 is provided so as to block the straight line L1 connecting the lowermost point Q of the developer discharge port 94 to the top P of the upper part of the wing portion 8*b* of the supply screw 8. Accordingly, the developer that is scattered from the top P of the upper part of the supply screw 8 in the tangential direction of a circumference drawn by a wing portion is prevented from passing through the developer discharge port 94. Moreover, as shown in FIG. 8, because the block member 3 is disposed so as to cut off the straight line L1 from the casing of the developing device 4 on the upper part of the supply conveyance path 9, the path through which the developer scattered above the straight line L1 moves toward the developer discharge port 94 can be prevented from being blocked (arrow T in FIG. 22). Therefore, the scattered developer can be securely prevented from reaching the developer discharge port 94.

Furthermore, by using a sponge or other elastic material as the material of the block member 3, the bulk of the developer increases to reach the lower surface of the block member 3, and the block member 3 is deformed when the bulk of the developer further increases. Such deformation can prevent the increase of the stress on the developer that is caused when the developer is blocked by the lower surface of the block member 3.

Moreover, in Example 2, the plurality of plate-like members 3*a* are disposed at intervals as the scattered developer discharge prevention members. Accordingly, when the amount of developer within the developing device 4 increases and thereby the bulk of the developer increases, the increment of the developer enters a space between the plate-like members 3*a*. Therefore, the effect of scattering of the developer can be securely eliminated without applying pressure on the developer, and only the increment of the developer can be led to the developer discharge port 94.

In Example 3, the upstream side in the conveyance direction of the supply screw 8 with respect to the developer discharge port 94 is provided with, as the scattered developer discharge prevention member, the upstream side wall member 38, which is a wall member with the wall surface 38*f* which is perpendicular to the conveyance direction of the supply screw 8 serving as the developer conveying member, and a normal line direction of which runs in an opposite direction to the conveyance direction of the supply screw 8. Accordingly, the developer T1 flying in the conveyance direction of the axial direction of the supply screw 8 can be prevented from being discharged directly from the developer discharge port 94.

Moreover, in Example 3, the downstream side in the conveyance direction of the supply screw 8 with respect to the developer discharge port 94 is provided with, as the scattered developer discharge prevention member, the downstream side wall member 39 that is a wall member with the wall surface 39*f* which is perpendicular to the conveyance direction of the supply screw 8 serving as the developer conveying member, and a normal line direction of which runs in the same direction as the conveyance direction of the supply screw 8. Accordingly, the developer T2 flying in the opposite direction to the conveyance direction of the axial direction of the supply screw 8 can be prevented from being discharged directly from the developer discharge port 94.

Moreover, the downstream side of the developer discharge port 94 of the supply conveyance path 9 serving as the developer conveyance path is provided with the downstream end wall surface 9*e* which is perpendicular to the conveyance direction of the supply screw 8 serving as the developer conveying member and a normal line direction of which runs in the opposite direction to the conveyance direction of the supply screw 8, and which prevents the movement of the developer in the conveyance direction. The developer discharge port 94 is provided such that the foot of the developer that is prevented from being conveyed and thereby is increased by the downstream side wall surface 9*e* is caught in the developer discharge port 94. Therefore, the developer discharge port 94 can be prevented from being clogged up by the developer.

Moreover, the upstream side wall lower end portion 38*e* and the downstream side wall lower end portion 39*e* that are the lower ends of the wall members of the upstream side wall member 38 and the downstream side wall member 39 respectively are positioned below the lower end of the developer discharge port 94. Therefore, the developers (T1, T2) flying in the axial direction of the supply screw 8 can be securely prevented from being discharged directly from the developer discharge port 94.

The developer conveying member within the supply conveyance path 9 is the developer conveying screw 8 that has the rotation axis and the wing portions provided in a spiral form on the rotation axis and conveys the developer in the rotational axial direction by rotating itself. Therefore, the developer can be conveyed within the supply conveyance path 9 using the simple configuration.

In the planar surface that is perpendicular to the conveyance direction of the supply screw 8 serving as the developer conveying screw, the shape of the upstream side wall lower end portion 38*e* and the shape of the downstream side wall lower end portion 39*e* located at the lower ends of the upstream side wall member 38 and the downstream side wall member 39 serving as the scattered developer discharge prevention members respectively have a round shape so as to follow the shape of the upper part of the wing portion of the supply screw 8. Accordingly, the developers (T1, T2) flying in the axial direction of the supply screw 8 can be securely prevented from being discharged directly from the developer discharge port 94.

The above example has the developer discharge port 94 in the supply conveyance path 9, which is the developer supply conveyance path to which the developer is conveyed by the supply screw 8 serving as the developer conveying screw for conveying the developer in the developer supply region $\alpha$ of the developer conveyance path. Also, the developing roller 5 serving as the developer carrier is disposed on the side where the wing portion of the supply screw 8 moves from the lower side to the upper side as it rotates. Accordingly, the developer can be stably supplied to the developing roller 5. Moreover, the developer discharge port 94 is disposed on the side where the wing portion of the supply screw 8 moves from the upper side to the lower side as it rotates, i.e., on the opposite side of the developing roller 5 across the supply screw 8. Accordingly, the size of the developing device 4 can be reduced.

According to Embodiment 2, Example 4 has the rotation axis 8*a*, the wing portions 8*b* that are provided in a spiral form on the rotation axis 8*a*, and the supply screw 8 for conveying the developer in the rotational axial direction by rotating itself, wherein the external diameter R2 of the wing portion 8*b* within a developer discharge region η provided with the developer discharge port 94 with respect to the developer conveyance direction of the supply conveyance path 9 is smaller than the external diameter R1 of the wing portion 8*b* located on the upstream side in the developer conveyance direction of the developer discharge region η. Therefore, the speed of conveyance of the developer within the developer discharge region η can be made slower than the speed of conveyance of the developer within other part. If the speed of conveyance is low, the moving force of the developer becomes weak, so that the developer does not scatter easily. Moreover, by making the external diameter s small, the force of the developer moving in the direction of the external diameter of the wing portions 8*b* becomes weak, so that the developer does not scatter easily. In this manner, the rotation of the supply screw 8 can prevent the developer from scattering in the developer discharge region η. Accordingly, the scattered developer cannot easily reach the developer discharge port 94 and is prevented from being discharged therefrom. Furthermore, the developer is prevented from being discharged even if the amount of developer within the developing device 4 is not increased. Therefore, a necessary amount of developer can be secured within the developing device 4, and the developer can be supplied to the latent image carrier stably.

Furthermore, in Example 5, the pitch width P2 of the wing portion 8*b* within the developer discharge region η is set to be narrower than the pitch width P1 of the wing portion 8*b* positioned on the upstream side in the developer conventional direction in the developer discharge region η, and thus the speed of conveyance of the developer within the developer discharge region η can be made slower than the speed of conveyance of the developer within other part, as with the case of Example 4. Therefore, as with the case of Example 4, a necessary amount of developer can be secured within the developing device 4, and the developer can be supplied to the latent image carrier stably.

In Example 6, the supply screw 8 within the developer discharge region η does not have the wing portions 8*b* but the rotation axis 8*a*, and thus, as with the case of Example 4, the speed of conveyance of the developer within the developer discharge region η can be made slower than the speed of conveyance of the developer within other part. Therefore, as with the case of Example 4, a necessary amount of developer can be secured within the developing device 4, and the developer can be supplied to the latent image carrier stably.

The supply screw 8 that is provided in the developing device 4 having the configuration of Embodiment 2 can be applied to the developing device 4 having the configuration of Embodiment 1. Accordingly, the scattered developer can be securely prevented from being discharged, and also the developer can be prevented from being discharged although the amount of developer within the developing device 4 is not increased.

In the developing device 4 that circulates the developer unidirectionally and has the supply conveyance path 9, stirring conveyance path 10 and recovery conveyance path 7, the developer is discharged at the position where the developer accumulates to reach the downstream end in the conveyance direction of the supply conveyance path 9. Therefore, the increment of the developer obtained by replenishing of the premixed toner can be discharged properly.

By providing the developing device 4 as the developing means of the copying machine serving as the image forming apparatus, the life of the developing means can be increased by replacing the developer, and at the same time the occurrence of image omission and other abnormal images can be prevented so that excellent image formation can be performed.

[Modification]

Note that the developing devices 4 of Embodiment 1 and Embodiment 2 are configured such that the supply conveyance path 9 is disposed higher than the stirring conveyance path 10 and the recovery conveyance path 7. Such a configuration is not limited to the developing device 4 to which can be applied the configuration of saving the space of the upper part of the developing device 4 as shown in FIG. 4. Next is described a modification of the developing device in which the three developer conveyance paths of the supply conveyance path 9, the stirring conveyance path 10 and the recovery conveyance path 7 are disposed at substantially the same height. Note that because the only difference between the modification and Embodiment 1 is the shape of the developing device 4 and the rest of the configurations are identical, the developing device 4, which is the only difference, will be described.

Figure 21:
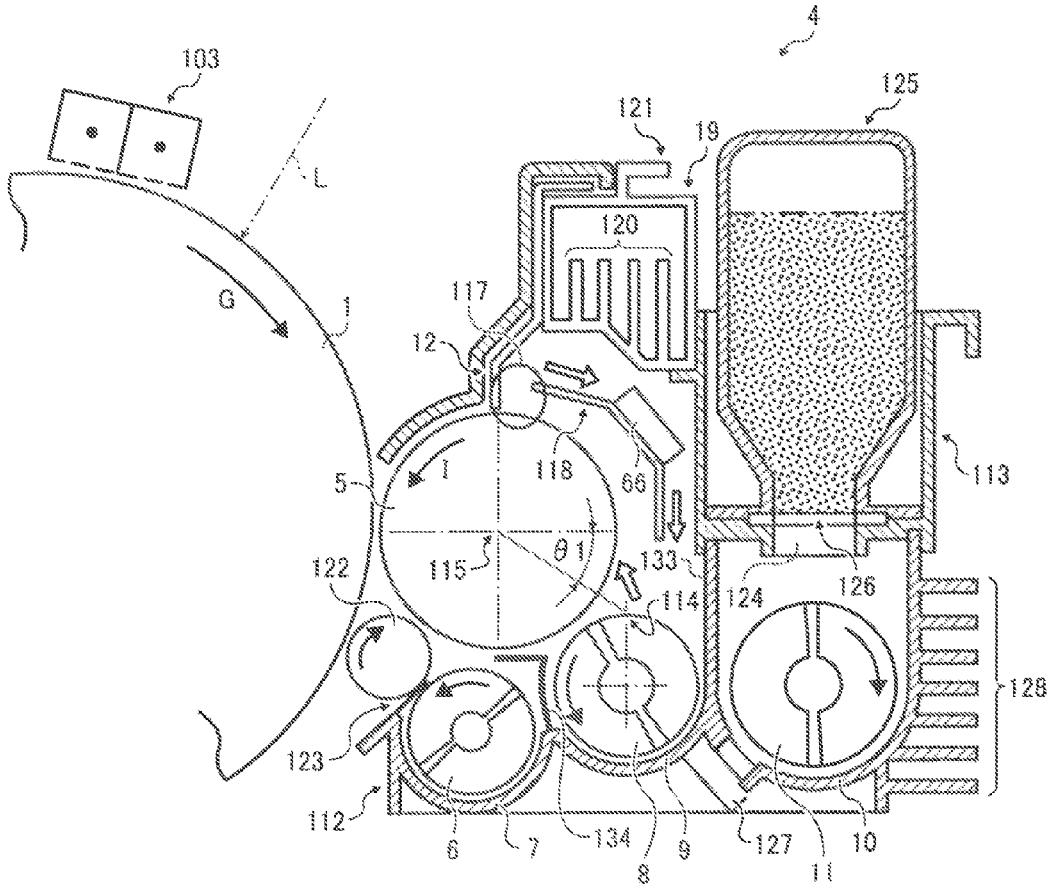
FIG. 21 is a view showing schematic configurations of the developing device and the photoreceptor according to a modification of the present embodiment.

FIG. 21 shows a schematic configuration of the developing device 4 according to this modification.

As shown in FIG. 21, as the photoreceptor 1 rotates in the direction of the arrow G, the surface of the photoreceptor is charged by a scorotron charger 103. On the charged surface of the photoreceptor 1, an electrostatic latent image is formed by a laser beam irradiated from an exposure device, not shown, and the toner is supplied from the developing device 4 to the latent image, whereby toner image is formed.

The developing device 4 has a developing roller 5 that serves as a developer carrier for supplying the toner to develop the latent image on the surface of the photoreceptor 1 while surface-moving in the direction of the arrow I of the drawing. The developing device 4 also has a supply screw 8 serving as a supply conveying member for, while supplying the developer to the developing roller 5, conveying the developer in the direction toward the rear side of FIG. 21.

A development doctor 12 serving as a developer regulating member for regulating the thickness of the developer supplied to the developing roller 5 to a thickness suitable for development is provided on the downstream side in the direction of surface movement of the developing roller 5 from a part facing the supply screw 8.

A recovery screw 6 serving as a recovery conveying member for recovering the developer that has passed through the developing portion and used for development and for carrying the recovered recovery developer in the same direction as the direction of the supply screw 8 is provided on the downstream side in the direction of surface movement of the developing roller 5 from the developing portion which constitutes a part facing the photoreceptor 1. The supply conveyance path 9 having the supply screw 8 and the recovery conveyance path 7 having the recovery screw 6 are arranged in parallel with each other below the developing roller 5. The two conveyance paths, the supply conveyance path 9 and the recovery conveyance path 7, are partitioned by the second partition wall 134 serving as a partition member.

A stirring conveyance path 10 serving as a stirring conveyance path is provided in the developing device 4 in parallel with the opposite side of the recovery conveyance path 7 of the supply conveyance path 9. The stirring conveyance path 10 has the stirring screw 11 serving as a stirring/conveying member for, while stirring the developer, conveying it in the opposite direction to the supply screw 8, the opposite direction being oriented on the near side in the drawing. The supply conveyance path 9 and the stirring conveyance path 10 are partitioned by a first partition wall 133 serving as a partition member. An opening portion is formed the first partition wall 133 at both ends in the near side and far side of the drawing to connect the supply conveyance path 9 and the stirring conveyance path 10 to each other. The stirring conveyance path 10 is supplied with excess developer that is supplied into the supply conveyance path 9 and conveyed to the downstream end in the conveyance direction of the supply conveyance path 9 without being used for development, and the recovery developer that is conveyed by the recovery screw 6 to the downstream end in the conveyance direction of the recovery conveyance path 7. The stirring conveyance path 10 stirs the supplied excess developer and recovery developer, and conveys them to the downstream side in the conveyance direction of the stirring screw 11. Then, the supply opening portion 91 that is provided on the first partition wall 133 supplies the developer to the supply conveyance path 9 on the upstream side in the conveyance direction of the screw 8.

On the second partition wall 134, the end on the far side of the diagram that is located on the lowermost stream side in the conveyance direction of the recovery screw 6 is configured as an opening portion to link the supply conveyance path 9 to the recovery conveyance path 7. The three conveyance paths, i.e., the downstream end in the conveyance direction of the recovery screw 6, the downstream end in the conveyance direction of the supply screw 8, and the upstream end in the conveyance direction of the stirring screw 11, are linked together.

The recovery developer that is conveyed to the downstream end in the conveyance direction of the recovery conveyance path 7 is transported to the supply conveyance path 9. Furthermore, the recovery developer and the developer that is conveyed by the supply screw 8 but is not supplied to the developer 5 are transported to the linked stirring conveyance path 10.

In the stirring conveyance path 10, the recovery developer, excess developer, and toner replenished from a transporting section according to need are stirred and conveyed in the direction opposite to that of the developer of the recovery path 7 and the supply path 9, by the stirring screw 11. The stirred developer is transported to the upstream side in the direction of conveyance of the supply conveyance path 9 that is communicated at the downstream side in the direction of conveyance. Note that a toner density sensor 127 is provided below the stirring conveyance path 10, and a toner replenishing device (not shown) is actuated by the output of the sensor so that the toner is replenished from the transporting section.

The casing of the developing device 4 is configured from a lower casing 112 and an upper casing 113 that are integrally molded and divided into top and bottom parts by the axis portions of three conveying screws. The first partition wall 133 is a part of the lower casing 112, and the second partition wall 134 is held by the upper casing 113 and joined to the lower casing 112.

Note that a system using a known mono pump can be adopted as the abovementioned toner replenishment control device. According to this system, there is no restriction in installation positions of the toner cartridge, hence this system is advantageous in terms of space allocation in the image forming apparatus. Moreover, since the toner can be replenished on a timely basis, it is not necessary to provide the developing device 4 with a large toner storage space. Therefore, the downsizing of the developing device 4 can be achieved.

As shown in FIG. 21, a screw top 114 of the supply screw 8, located in the uppermost part of the supply member, is disposed lower than a rotation center 115 of the developing roller 5. In the developing device 4, the angle θ1 between the straight line connecting the rotational centre 115 of the developing roller 5 to the screw top 114 and the horizontal straight line passing through the rotation center 115 is set to 30[°]. The angle θ1 changes according to the diameter of the supply screw 8, but it is preferably set to 10[°] through 40[°] in terms of the layout in order to achieve the downsizing of the developing device 4.

The developer is supplied to the developing roller 5 because a magnetic pole provided within the developing roller 5 attracts the magnetic carrier contained in the developer. As described above, the screw top 114 is disposed lower than the rotation center 115 of the developing roller 5, hence the magnitude of the magnetic force contributes to the amount of developer supplied to the developing roller, without having an effect of the weight of the developer on the amount of developer supplied to the developing roller 5. Accordingly, the developer to be conveyed by the supply conveyance path 9 is securely supplied from the upper part of the developer, and thus an appropriate amount of developer can be supplied to the developing roller 5 even if the bulk of the developer within the supply conveyance path 9 is not even in the conveyance direction of the supply screw 8.

In the developing device in which the conventional three developer conveyance paths are disposed at the same height, the supply opening portion for delivering the developer from the stirring conveyance path 10 to the supply conveyance path 9 was provided outside the developing region width α. Therefore, compared to the developing roller 5 and the recovery conveyance path 7, the upstream end portions in the conveyance directions of the stirring conveyance path 10 and the supply conveyance path 9 protrude largely.

In the developing device 4 of the modification, because the supply opening portion is provided within the developing region width α, such protrusions of the stirring conveyance path 10 and the supply conveyance path 9 that are greater than those of the developing roller 5 and the recovery conveyance path 7 are eliminated, hence the space saving of the developing device 4 can be achieved.

In addition, in the developing device 4 of the modification, because the recovery conveyance path 7, the stirring conveyance path 10 and the supply conveyance path 9 are disposed at substantially the same height, stress placed on the developer can be alleviated so that the life of the developer can be increased. Specifically, by disposing the three developer conveyance paths at the same height, the developer does not have to be lifted up in the developer conveyance paths, hence the stress placed on the developer can be alleviated. Accordingly, developer deterioration can be prevented, and stable image quality can be maintained.

As described above, according to the present invention, the developer is prevented from being discharged, despite that the amount of developer within the developing device is not increased. Therefore, the present invention has the excellent effects that a necessary amount of developer can be secured within the developing device, and that the developer can be supplied stably to the latent image carrier.

Various modifications will become possible for those skilled in the art after receiving the teachings of the present disclosure without departing from the scope thereof.

What is claimed is:

1. A developing device, comprising:

a developer carrier, configured to rotate while carrying a developer on a surface thereof, supplies a toner to a latent image on a surface of a latent image carrier at a section where the developer carrier faces the latent image carrier, and develops the latent image;

a developer conveyance path, which has a developer conveying member conveying the developer, and conveys the developer while supplying the developer to the developer carrier in a developer supply region in which the developer is supplied to the developer carrier;

a developer replenishing device configured to replenish the developer to the developer conveyance path;

a developer discharge port which is provided in the developer conveyance path and which discharges the developer to the outside of the developing device, at a predetermined height level of a position in which the bulk of the developer increases or decreases as the amount of developer within the entire developer conveyance path increases or decreases; and a scattered developer discharge prevention member blocking a path along which the developer, scattered as a result of a conveyance operation of the developer conveying member, moves toward the developer discharge port.

2. The developing device as claimed in claim 1, wherein the developer conveying member is a developer conveying screw that has a rotation axis and a wing portion provided in a spiral form on the rotation axis, and conveys the developer in a direction of the rotation axis by rotating, and wherein the scattered developer discharge prevention member is provided so as to block a straight line connecting the lowermost point of the developer discharge port to the top of an upper part of the wing portion.

3. The developing device as claimed in claim 2, wherein in the developer conveying screw, a conveying force of the wing portion within a developer discharge region is smaller than a conveying force of the wing portion positioned on an upstream side in a developer discharge direction of the developer discharge region.

4. The developing device as claimed in claim 1, wherein the scattered developer discharge prevention member is made of an elastic material.

5. The developing device as claimed in claim 1, wherein the scattered developer discharge prevention member is obtained by disposing a plurality of plate-like members at intervals.

6. The developing device as claimed in claim 1, wherein a wall member that has a wall surface which is perpendicular to a conveyance direction of the developer conveying member and a normal line direction of which runs in an opposite direction to the conveyance direction of the developer conveying member is provided as the scattered developer discharge prevention member on an upstream side in the conveyance direction of the developer conveying member, with respect to the developer discharge port.

7. The developing device as claimed in claim 1, wherein a wall member that has a wall surface which is perpendicular to a conveyance direction of the developer conveying member and a normal line direction of which runs in the same direction as the conveyance direction of the developer conveying member is provided as the scattered developer discharge prevention member on a downstream side in the conveyance direction of the developer conveying member, with respect to the developer discharge port.

8. The developing device as claimed in claim 1, further comprising, on a downstream side of the developer discharge port within the developer conveyance path, a downstream end wall surface, which is perpendicular to a conveyance direction of the developer conveying member, a normal line direction of which runs in an opposite direction to the conveyance direction of the developer conveying member, and which prevents the developer from moving in the conveyance direction, wherein the developer discharge port is provided such that the foot of the developer that is prevented from being conveyed and thereby rises due to the downstream end wall surface is caught in the developer discharge port.

9. The developing device as claimed in claim 6, wherein a lower end of the wall member is positioned lower than a lower end of the developer discharge port.

10. The developing device as claimed in claim 1, wherein the developer conveying member is a developer conveying screw that has a rotation axis and a wing portion provided in a spiral form on the rotation axis, and conveys the developer in a direction of the rotation axis by rotating.

11. The developing device as claimed in claim 10, wherein a lower end of the scattered developer discharge prevention member on a planar surface perpendicular to a conveyance direction of the developer conveying screw has a round shape so as to follow the shape of an upper part of the wing portion of the developer conveying screw.

12. The developing device as claimed in claim 10, wherein the developer discharge port is provided within a developer supply conveyance path through which the developer is conveyed by a supply screw serving as the developer conveying screw conveying the developer in the developer supply region of the developer conveyance path, the developer carrier is disposed on a side in which the wing portion of the supply screw moves from a lower part to an upper part as the supply screw rotates, and the developer discharge port is disposed on a side in which the wing portion of the supply screw moves from the upper part to the lower part as the supply screw rotates.

13. The developing device as claimed in claim 1, further comprising:

a supply conveyance path having a supply conveying member for conveying the developer along an axis line direction of the developer carrier and supplying the developer to the developer carrier;

a recovery conveyance path having a recovery conveying member for conveying the developer recovered from above the developer carrier after the developer passes through the section facing the latent image carrier, along the axis line direction of the developer carrier and in the same direction as the direction of the supply conveying member; and a stirring conveyance path having a stirring conveying member which is supplied with excess developer conveyed to the lowermost stream in a conveyance direction of the supply conveyance path without being used for development, and recovery developer recovered from the developer carrier and conveyed to the lowermost stream in a conveyance direction of the recovery conveyance path, and which conveys the excess developer and the recovery developer in an opposite direction to the direction of the supply conveying member while stirring the excess developer and the recovery developer, the stirring conveyance path further supplying the stirred developers to the supply conveyance path, wherein the developer conveyance path is configured by three developer conveyance paths of the recovery conveyance path, the supply conveyance path, and the stirring conveyance path, and has the recovery conveying member, the supply conveying member and the stirring conveying member as the developer conveying member.

14. The developing device as claimed in claim 13, wherein the developer discharge port is disposed in the vicinity of a downstream end in a developer conveyance direction of the supply conveyance path.

15. A developing device, comprising:

a developer carrier, configured to rotate while carrying a developer on a surface thereof, supplies a toner to a latent image on a surface of a latent image carrier at a section where the developer carrier faces the latent image carrier, and develops the latent image;

a developer conveyance path, which has a developer conveying member conveying the developer, and conveys the developer while supplying the developer to the developer carrier in a developer supply region in which the developer is supplied to the developer carrier;

a developer discharge port which is provided in the developer conveyance path and which discharges the developer to the outside of the developing device, at a predetermined height level of a position in which the bulk of the developer increases or decreases as the amount of developer within the entire developer conveyance path increases or decreases; and a scattered developer discharge prevention member blocking a path along which the developer, scattered as a result of a conveyance operation of the developer conveying member, moves toward the developer discharge port, wherein the developer conveying member is a developer conveying screw that has a rotation axis and a wing portion provided in a spiral form on the rotation axis, and conveys the developer in a direction of the rotation axis by rotating, and a conveying force of the wing portion within a developer discharge region provided with the developer discharge port is smaller than a conveying force of the wing portion positioned on an upstream side in a developer discharge direction of the developer discharge region.

16. The developing device as claimed in claim 15, wherein an external diameter of the wing portion positioned within the developer discharge region provided with the developer discharge port is smaller than an external diameter of the wing portion positioned on the upstream side in a developer conveyance direction of the developer discharge region.

17. The developing device as claimed in claim 15, wherein a pitch width of the wing portion positioned within the developer discharge region provided with the developer discharge port is narrower than a pitch width of the wing portion positioned on the upstream side in a developer conveyance direction of the developer discharge region.

18. The developing device as claimed in claim 15, wherein the developer conveying screw positioned within the developer discharge region provided with the developer discharge port does not have the wing portion.

19. An image forming apparatus, comprising:

at least a latent image carrier;

charging means for charging the surface of the latent image carrier;

latent image forming means for forming an electrostatic latent image on the latent image carrier; and developing means for developing the electrostatic latent image to form a toner image, wherein the developing means has:

a developer carrier, configured to rotate while carrying a developer on a surface thereof, supplies a toner to a latent image on a surface of a latent image carrier at a section where the developer carrier faces the latent image carrier, and develops the latent image;

a developer conveyance path, which has a developer conveying member conveying the developer, and conveys the developer while supplying the developer to the developer carrier in a developer supply region in which the developer is supplied to the developer carrier;

a developer replenishing device configured to replenish the developer to the developer conveyance path;

a developer discharge port which is provided in the developer conveyance path and which discharges the developer to the outside of the developing means, at a predetermined height level of a position in which the bulk of the developer increases or decreases as the amount of developer within the entire developer conveyance path increases or decreases; and a scattered developer discharge prevention member, blocking a path along which the developer, scattered as a result of a conveyance operation of the developer conveying member moves toward the developer discharge port.

* * * * *